US007301289B2

(12) United States Patent
Okamoto et al.

(10) Patent No.: US 7,301,289 B2
(45) Date of Patent: Nov. 27, 2007

(54) DISCHARGE LAMP LIGHTING CONTROL DEVICE

(75) Inventors: Masashi Okamoto, Hyogo (JP); Isao Miyake, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/342,840

(22) Filed: Jan. 31, 2006

(65) Prior Publication Data

US 2006/0170375 A1 Aug. 3, 2006

(30) Foreign Application Priority Data

Feb. 1, 2005 (JP) ..... 2005-025305

(51) Int. Cl.
*G05F 1/00* (2006.01)

(52) U.S. Cl. ..... 315/291; 315/307; 315/308; 315/297; 315/224

(58) Field of Classification Search ..... 315/291, 315/307–311, 224, 225, 293–295
See application file for complete search history.

(56) References Cited

U.S. PATENT DOCUMENTS 6,909,249 B2 * 6/2005 Otake ..... 315/291
7,034,607 B2 * 4/2006 Otake ..... 327/590

FOREIGN PATENT DOCUMENTS

| | | |
|---|---|---|
| JP | 10-3996 A | 1/1998 |
| JP | 11-283781 A | 10/1999 |
| JP | 11-339993 A | 12/1999 |

* cited by examiner

*Primary Examiner*—Tuyet Vo
(74) *Attorney, Agent, or Firm*—Rader, Fishman & Grauer, PLLC

(57) ABSTRACT

The present discharge lamp lighting device is capable of rapidly breaking or restoring a lamp current or of rapidly reducing or restoring the lamp current. A discharge lamp lighting device, comprises a power supply circuit which supplies power to a discharge lamp, a current breaking switch circuit which selectively interrupts a current flowing through the discharge lamp, a lamp condition detector which detects a condition of the discharge lamp, a target signal generating circuit which generates a target signal for lighting the discharge lamp in a predetermined condition, based on an output from the lamp condition detector, and a target signal holding circuit which selectively holds the target signal, wherein when the current is interrupted by the current breaking switch circuit, the target signal holding circuit holds the target signal.

3 Claims, 13 Drawing Sheets

FIG. 1
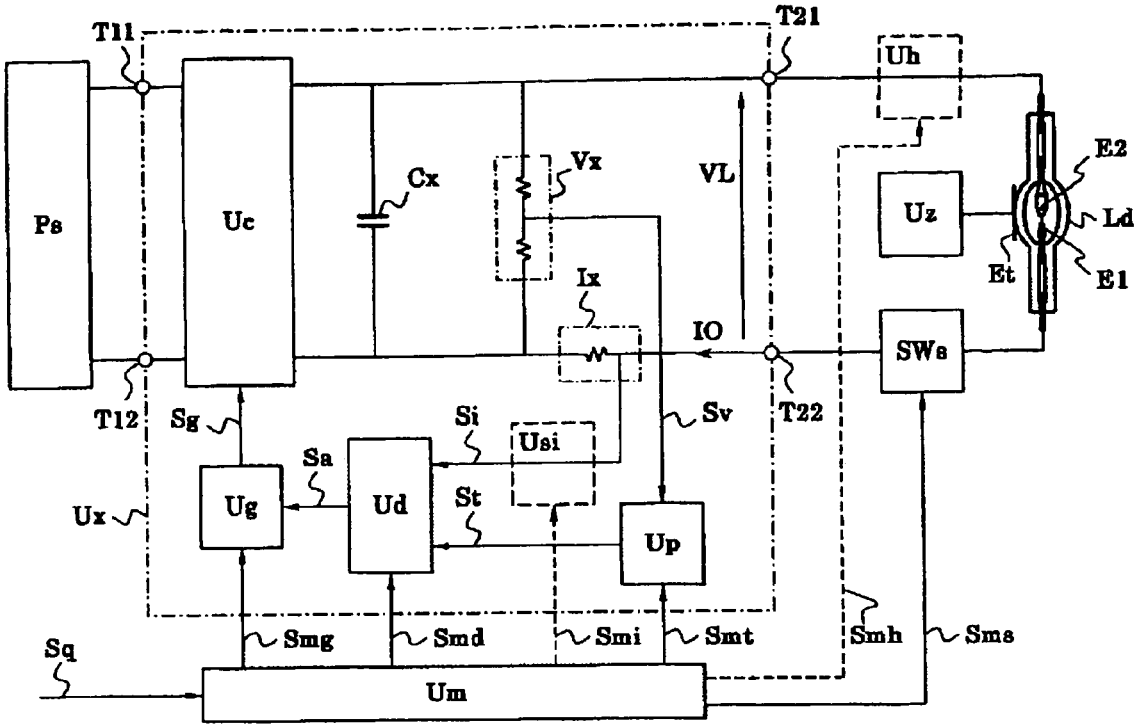
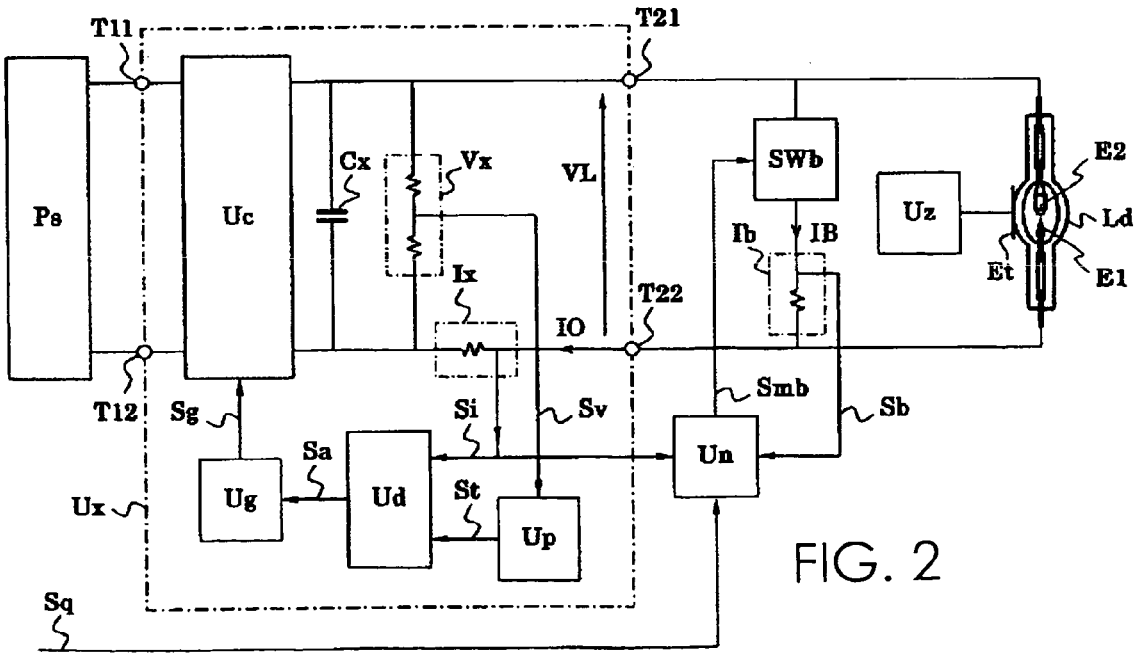
FIG. 2

FIG. 9
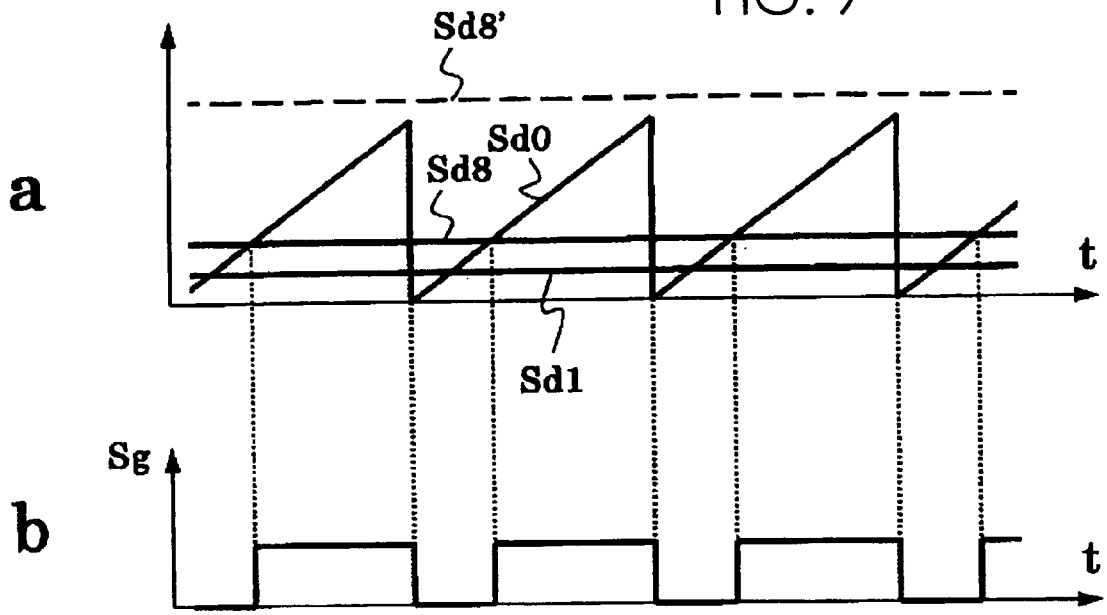
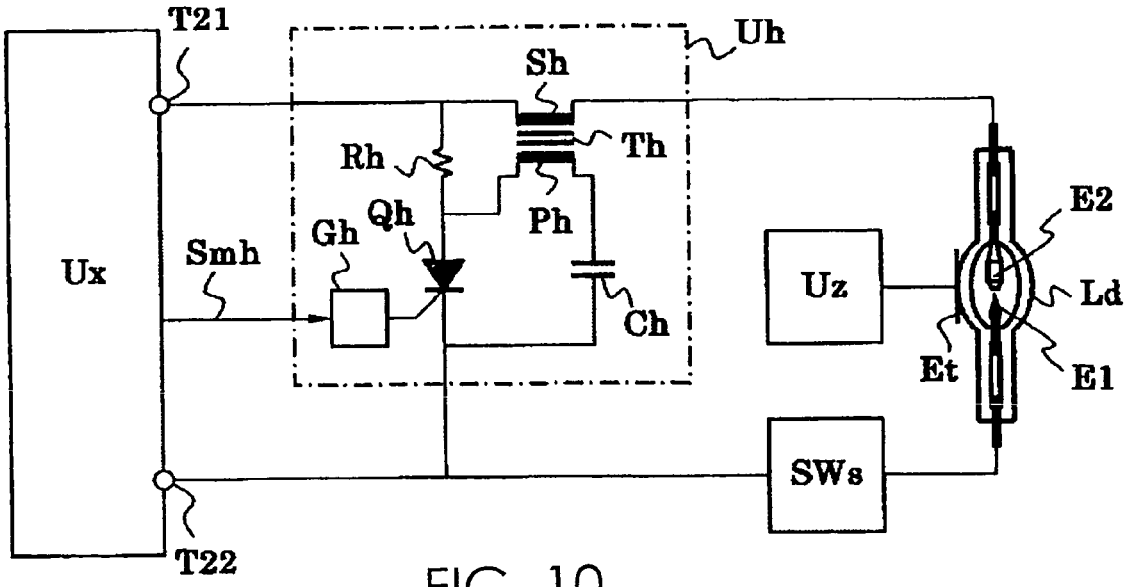
FIG. 10

FIG. 13
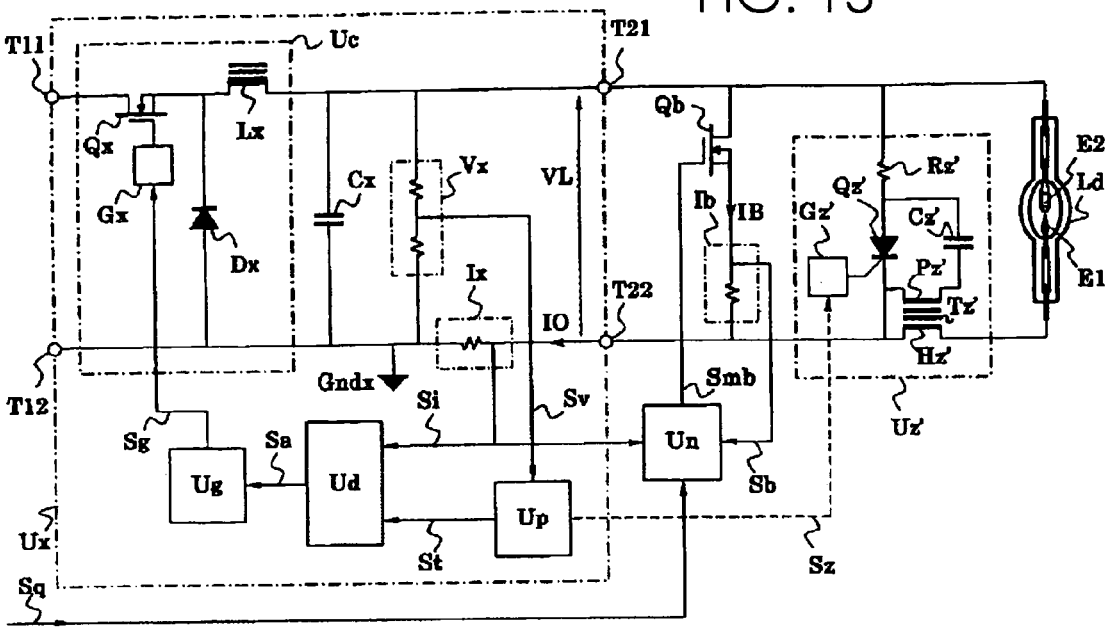
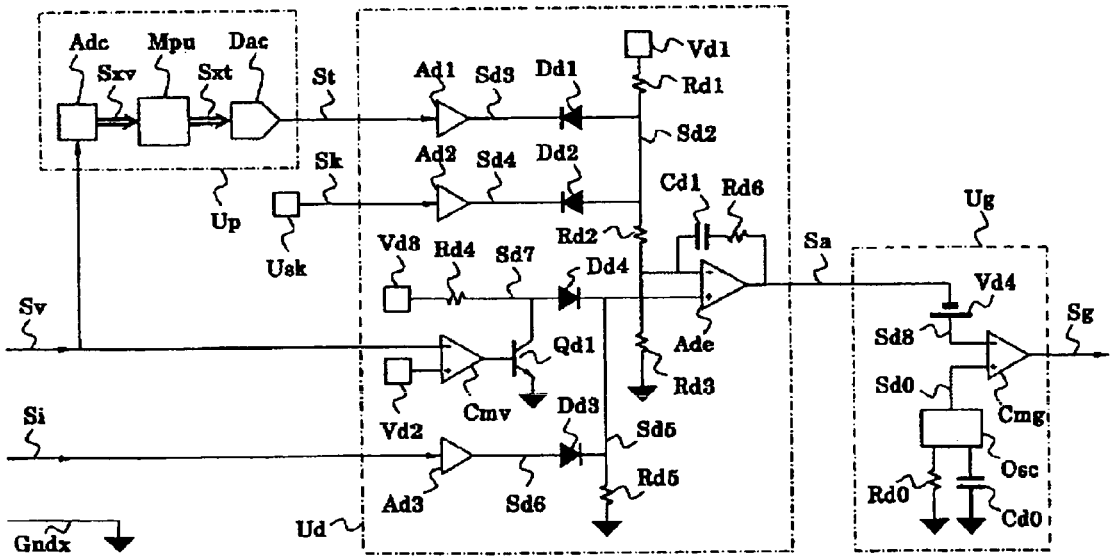
FIG. 14

DISCHARGE LAMP LIGHTING CONTROL DEVICE

RELATED APPLICATION

The disclosure of Japanese Patent Application No. 2005-025305, filed Feb. 1, 2005, including the specification, claims and drawings thereof, is incorporated herein by reference in its entirety.

TECHNICAL FIELD OF THE INVENTION

The present invention relates to a discharge lamp lighting device for lighting a discharge lamp, particularly, a high intensity discharge lamp, such as a high-pressure mercury lamp, a metal halide lamp, and a xenon lamp.

DESCRIPTION OF RELATED ART

For example, a high intensity discharge lamp (an HID lamp) is used for a light source device of an image displaying optical apparatus, such as a liquid crystal projector or a DLP (TM) projector. In order to light this type of lamp, a voltage, called a no-load open discharge voltage, is applied to the lamp, and then a high voltage is overlapped the voltage to generate a dielectric breakdown in a discharge space. Then, a glow discharge and an arc discharge sequentially occur.

In general, the HID lamp is lighted with a uniform voltage, that is, uniform brightness. However, in certain instances, the brightness of the HID lamp needs to be reduced rapidly, or a current flowing through the HID lamp needs to be broken for a short time.

For example, as an example of the breaking and reduction modulations, when the HID lamp is applied to a light source device for image display of the DLP projector, a rotary filter having regions for three primary colors, red, green, and blue is used. In a period during which light emitted from a light source is incident on boundaries between the color regions of the filter, light emitted from the filter does not have a pure color. Therefore, when color reproducibility is concerned very highly, light emitted from the filter in this period is not used for image display by a spatial modulation element. That is, when power is not supplied to the lamp within the periods and power is supplied the lamp at periods other than the periods of no power supply, a waste of power consumption is reduced, which is preferable from the viewpoint of power savings. In addition, in this case, since a small amount of heat is generated, cooling capability required for the lamp, the power supply circuit, and the spatial modulation element is reduced, which is preferable in reducing the size, weight, noise, and manufacturing costs of a device.

However, a lamp current should be rapidly broken in a current breaking period, and the lamp current should return to its original state where the current was immediately before the interruption, when the current breaking period is passed. If the lamp current is slowly broken, it slowly returns to its original state, or overshoot or oscillation occurs in the waveforms of the lamp current at the time of return, the image quality of a projector is deteriorated. In order to prevent the deterioration of image quality, the lamp current needs to return to its original state earlier than a required return timing for removing oscillation, which makes it difficult to reduce power consumption.

Further, in this case, when the lamp current is completely interrupted, the temperature of electrodes or plasma in the lamp discharge space is rapidly lowered in this period.

Therefore, even if the power supply circuit has capability of rapidly breaking the lamp current or of returning it to the original state, a long breaking time causes a problem in that the discharge lamp cannot resume discharge, or an abnormal emission spectrum occurs immediately after the discharge. Under these conditions, it is advantageous to greatly reduce a lamp current, not to completely break the lamp current.

However, when the lamp current is reduced, it is necessary to quantitatively reduce the lamp current. For example, it is necessary to reduce the lamp current to 25% of lamp current at the time of a normal lighting mode. In this case, when the reduced lamp current is non-uniform due to a variation in the lamp current or a variation in characteristics depending on the life span of the lamp, the lamp current after returning from the reduced state to its original state is also non-uniform. Then, the timing of resuming the spatial modulation of the projector apparatus is delayed, which causes a problem in that the waveform of the lamp current oscillates at the time of return.

The discharge lamp lighting device for an HID lamp is configured so as to compare power supplied to a lamp with a predetermined power target value and to perform feedback control so as to be equal to each other, thereby obtaining desired power. In order to change the brightness of a light source, the discharge lamp lighting device changes the power target value.

More specifically, for example, there is a method of detecting a lamp voltage and a lamp current, in order to calculate a lamp power value by multiplying the current and the voltage, thereby comparing it with the power target value. In this case, the multiplication may be performed on an analog lamp voltage signal and an analog lamp current signal by using an analog multiplying circuit. Alternatively, a digital lamp voltage signal and a digital lamp current signal may obtained by a microprocessor having an AD converter integrated thereinto which is mounted on a discharge lamp lighting device, and the multiplication may be formed by using the microprocessor.

For example, Japanese Laid Open Patent No. 11-283781 discloses a method of detecting a lamp voltage and a lamp current, in order to calculate a current target value by dividing a power target value by the lamp voltage, thereby comparing the current target value with the lamp current. In this case, in order to calculate the current target value, a digital lamp voltage signal is obtained by using a microprocessor having an AD converter integrated thereinto, and multiplication is performed by using the microprocessor.

Further, for example, Japanese Laid Open Patent No. 11-339993 discloses a method of increasing the resistance value of a resistor for detecting a lamp current at the time of lighting control, by detecting the lamp current and a lamp voltage, inputting them into a multiplier, and comparing an output value of the multiplier with a reference value.

Furthermore, for example, Japanese Laid Open Patent No. 10-3996 discloses a device which includes a lamp voltage detecting unit for detecting a lamp voltage, a lamp current detecting unit for detecting a lamp current, and a variable voltage divider which performs a dividing operation on outputs of the two units to change a division ratio at the time of lighting control and which controls main circuits for lighting, on the basis of the output of the variable dividing unit.

The reason why the power target value is varied in order to change the brightness of a lamp is that an HID lamp has a specific voltage characteristic. That is, the voltage of the lamp is a relatively low value of 10 V immediately before an arc discharge is generated. However, thereafter, the lamp voltage rises with an increase in the temperature of the lamp, and the lamp turns to a normal lighting state. The voltage in the normal lighting state is almost stable for a short period, but changes due to, for example, the life span of electrodes in the long run. For example, the voltage of a lamp is about 60 V at the beginning of use, but it rises up to about 140 V at the end of the life span thereof. When the lamp has a rated voltage of about 200 W, the lamp has a lamp current of about 3.3 A at the beginning of use, but has a lamp current of about 1.4 A at the end of the life span thereof.

The brightness of a light source is proportional to power supplied to a lamp. Therefore, when the brightness of the lamp is changed, the power needs to be controlled such that it is reduced to about 80% of reference voltage, for example, rated power. However, as described above, the lamp current is changed in the HID lamp. Therefore, when the lamp power is modulated to change the brightness of the lamp, it is difficult to specify power only by specifying the lamp current. Thus, it is necessary to change the power target value.

However, the conventional techniques have the following problems. As a first problem, it is difficult to rapidly modulate the brightness of a light source. As compared with the technique of comparing power supplied to a lamp with a predetermined power target value in order to perform feedback control such that they are equal to each other, the method of changing the power target value needs multiplication or division. For example, in order for a high-speed modulation, the method needs to have a high-speed AD converter, a microprocessor, or a high-speed analog divider or multiplier, which results in an increase in manufacturing costs.

Further, in particular, when the microprocessor is used for AD conversion, multiplication, or division, signals are sampled every certain period and signal processing for modulation is performed. In this method, since the signal processing is performed every sampling period, it is difficult for an illumination request generating circuit to control modulation timing. In a method in which a timing signal is provided to give processing timing, since the time until the microprocessor responds to the timing signal by interruption depends on the processes that has been performed inside the processor until that time, the modulation timing cannot be accurately defined. Therefore, jitter (variation in the direction of the time axis) occurs in a modulation profile.

In order to solve the problem of the above structure in which the power target value is changed and modulated, a method of directly operating a PWM modulation circuit, such as a down chopper, of a converter without changing the power target value is considered. According to this method, it is unnecessary to change the power target value with time, resulting in a high-speed operation. In addition, it is possible to solve the problem of jitter by directly driving, for example, a transistor on the basis of signals output from a circuit-requiring modulation and by changing a duty cycle ratio of PWM modulation. However, this method has problems in that it cannot appropriately cope with a variation of the lamp voltage or a variation thereof with time, and be applied to deep modulation including the breaking of the lamp current, which is required for the above-mentioned breaking and reduction modulation.

The reason is as follows. In general, a power supply circuit for supplying power to a discharge lamp is provided with a smoothing capacitor for stabilizing an output voltage to reduce ripples. However, in case of deep modulation, a lamp voltage is excessively greatly changed due to modulation. Therefore, even if the power supply circuit has a high-speed modulation capability, the lamp needs to use, by power consume, some of charges stored in the smoothing capacitor, which correspond to a variation of the lamp voltage, in order to reduce the lamp current. On the other hand, in order to return the lamp current to its original level, the power supply circuit needs to increase the lamp current and to charge the smoothing capacitor. The two cases take time depending on the capacitance of the smoothing capacitor.

SUMMARY OF THE INVENTION

The present discharge lamp lighting device is capable of rapidly breaking or restoring a lamp current or of rapidly reducing or restoring the lamp current.

The present discharge lamp lighting device comprises a power supply circuit which supplies power to a discharge lamp, a current breaking switch circuit which selectively interrupts a current flowing through the discharge lamp, a lamp condition detector which detects a condition of the discharge lamp, a target signal generating circuit which generates a target signal for lighting the discharge lamp in a predetermined condition; and a target signal holding circuit which selectively holds the target signal, wherein when the current is interrupted by the current breaking switch circuit, the target signal holding circuit holds the target signal.

As described above, a discharge lamp lighting device of the invention can rapidly break or restore a lamp current or rapidly reduce or restore the lamp current.

BRIEF DESCRIPTION OF THE DRAWINGS

These and other features and advantages of the present discharge lamp lighting device will be apparent from the following description taken in conjunction with the accompanying drawings, in which:

FIG. 1 is a block diagram schematically illustrating a discharge lamp lighting device according to an embodiment of the present invention;

FIG. 2 is a block diagram schematically illustrating a discharge lamp lighting device according to an embodiment of the present invention;

FIG. 9 is a timing chart of another portion of the discharge lamp lighting device according to the embodiment of the invention;

FIG. 10 is a diagram schematically illustrating a discharge lamp lighting device according to an embodiment of the invention;

FIG. 13 is a diagram schematically illustrating a discharge lamp lighting device according to an embodiment of the invention;

FIG. 14 is a diagram schematically illustrating a portion of the discharge lamp lighting device according to the embodiment of the invention;

DETAILED DESCRIPTION OF THE INVENTION

Figure 3:
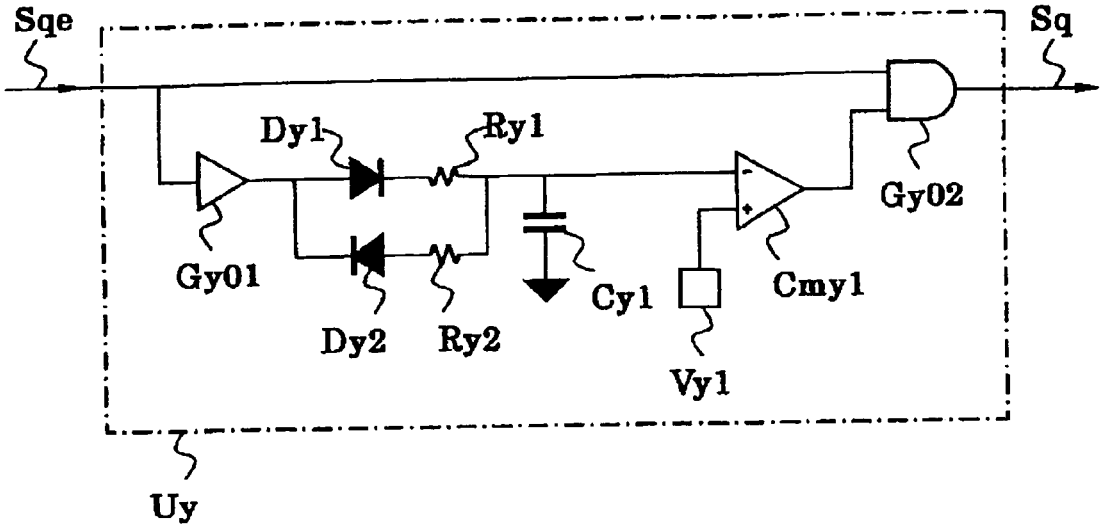
FIG. 3 is a diagram schematically illustrating a portion of the discharge lamp lighting device according to the embodiment of the invention.

FIG. 1 is a schematic block diagram illustrating an embodiment of a discharge lamp lighting device according to the invention having a current breaking switch circuit SWs for interrupting a current flowing through a discharge lamp Ld. An embodiment of the invention will be described with reference to FIG. 1. The discharge lamp Ld is connected to a start circuit Uz for initiating discharge thereof. FIG. 1 shows an external trigger in which a high voltage is applied to a trigger electrode Et provided outside the discharge lamp Ld. However, the trigger method does not concern the essence of the invention. A power supply circuit Ux is connected so as to supply power to the discharge lamp Ld through main discharge electrodes E1 and E2 of the discharge lamp Ld. The power supply circuit Ux has a function of converting the power supplied from a DC power source Ps into power suitable for the discharge lamp Ld by using a converter Uc which is, for example, a down-chopper type or an up-chopper type. A capacitor Cx for stabilizing an output voltage is provided at an output terminal of the converter Uc.

An output current detecting unit Ix detects an output current I of the power supply circuit Ux, that is, a lamp current, to generate and output an output current detecting signal Si to an output current error calculating circuit Ud. Further, when the output current detecting signal Si is a weak signal, an amplifier may be provided, if necessary. However, since the amplifier does not concern the essence of the invention, it is not omitted in this embodiment. A lamp voltage detecting unit Vx for generating a lamp voltage detecting signal Sv detects an output voltage VO of the power supply circuit Ux, that is, a lamp voltage to determine a lamp current value for realizing target power according to the lamp voltage, and outputs the determined value as an analog signal. For example, an output current target signal St is generated by a power control circuit Up including a microprocessor, and is then input to the output current error calculating circuit Ud.

The output current error calculating circuit Ud calculates an error of the output current detecting signal Si with respect to the output current target signal St, and controls a capability signal Sa for raising or lowering the capability (or conversion rate) of the converter Uc so as to reduce the error. Then, the output current error calculating circuit Ud outputs the capability signal Sa. A power supply driving circuit Ug receives the capability signal Sa to generate a gate driving signal Sg whose duty cycle is modulated in order to control switching elements of the converter Uc.

An output current modulation instruction signal Sq is input to a modulation control signal generating circuit Um. When the output current modulation instruction signal Sq is in an active state, the modulation control signal generating circuit Um activates an output current target holding signal Smt so as to hold the output current target signal St, activates a capability holding signal Smd so as to hold the capability signal Sa, activates a power supply driving stop signal Smg so as to stop the operation of the power supply driving circuit Ug, and activates a current breaking signal Sms so as to turn off the current breaking switch circuit SWs which is composed of, for example, an FET and is directly connected to the discharge lamp Ld.

In such a structure, when the output current modulation instruction signal Sq is in an inactive state, the current flowing through the discharge lamp Ld is controlled in a feedback manner such that power consumed in the discharge lamp Ld is held in a target power value. When the output current modulation instruction signal Sq is activated, the current breaking switch circuit SWs is turned off, so that the current flowing through the discharge lamp Ld is broken at high speed. When the output current modulation instruction signal Sq returns to the inactive state, the current breaking switch circuit SWs is turned on, so that the current flowing through the discharge lamp Ld rapidly returns to the value immediately before the output current modulation instruction signal Sq is activated. As a result, the current flowing through the discharge lamp Ld is controlled in a feedback manner such that power consumed in the discharge lamp Ld is held in a target power value.

Further, when the capability holding signal Smd is in an inactive state, the output current error calculating circuit Ud calculates an error of the output current detecting signal Si with respect to the output current target signal St and outputs the capability signal Sa (hold release state). However, when the capability holding signal Smd is in an active state, the output current error calculating circuit Ud holds the output state of the capability signal Sa immediately before the capability holding signal Smd is activated, regardless of the state of the output current detecting signal Si or the output current target signal St, which is an input signal. That is, the output current error calculating circuit Ud has a hold function. Similarly, when the output current target holding signal Smt is in an inactive state, the power control circuit Up outputs output current target signal St according to the lamp voltage detecting signal Sv (hold release state) However, when the output current target holding signal Smt is in an active state, the power control circuit Up holds the output state of the output current target signal St where the output state was immediately before the output current target holding signal is activated, regardless of the state of the lamp voltage detecting signal Sv, which is an input signal. That is, the output current error calculating circuit Ud has a hold function.

In this embodiment, when the output current target holding signal Smt is in an active state, the current breaking switch circuit SWs is turned off, and the capability signal Sa is held to stop the operation of the power supply driving circuit Ug. The region will be described below. When the output current modulation instruction signal Sq returns to the inactive state in a short time after the current braking switch circuit SWs is turned off, the current flowing through the discharge lamp Ld should rapidly return to the value which was obtained immediately before the current braking switch circuit SWs was turned off. If the current flowing through the discharge lamp Ld does not rapidly return to the value which was obtained immediately before the current braking switch circuit SWs was turned off, that is, if the current slowly returns to the value, the current returns to the value after an excessively large amount of current flows one time, or the current returns to the value in a damped oscillation manner, a lamp current waveform appears in the waveform of the emission amount of the lamp, causing the performance of the lamp which serves as a light source, to be deteriorated.

Therefore, it is necessary to stop the operation of the converter Uc in a state of time when the current breaking switch circuit SWs is turned off. If the operation of the converter Uc does not stop, a current is stored in the capacitor Cx, which causes the output voltage of the power supply circuit Ux to rise and the output current modulation instruction signal Sq to return to the inactive state. When the current breaking switch circuit SWs is turned on, the current flowing through the discharge lamp Ld does not rapidly return to the value which was obtained immediately before the current breaking switch circuit SWs was turned off, and an excessively large amount of current flows therethrough. Therefore, in order to solve this problem, it is necessary to stop the operation of the power supply driving circuit Ug.

Further, in a state in which the current breaking switch circuit SWs is turned off, the current flowing through the discharge lamp Ld is interrupted. Therefore, the output current detecting signal Si detected and generated by the output current detecting unit Ix is substantially a signal corresponding to zero ampere. If the capability signal Sa is not held, the output current error calculating circuit Ud detects a large error, and the capability signal Sa rapidly proceeds to a state requiring for the capability of the converter Uc. Then, when the output current modulation instruction signal Sq returns to the inactive state so that the current breaking switch circuit SWs is turned on, the operation is resumed from the state where the capability signal Sa requires an excessively large capacity of the converter Uc. Therefore, the current flowing through the discharge lamp Ld does not rapidly return to the value which was obtained immediately before the current breaking switch circuit SWs was turned off, and thus an excessively large amount of current flows therethrough. For this reason, it is necessary to hold the capability signal Sa.

As shown in broken lines in FIG. 1, a lamp-current-detecting-signal holding circuit Usi is provided to hold the signal detected by the output current detecting unit Ix. In this structure, when the output current modulation instruction signal Sq is in an active state, the lamp-current-detecting-signal holding circuit Usi holds the output current detecting signal Si, and the modulation control signal generating circuit Um activates the output current holding signal Smi. In this case, although the current breaking switch circuit SWs is turned off, the output current detecting signal Si held in the state at the time immediately before the current breaking switch circuit SWs was turned off, so that the output current error calculating circuit Ud does not detect a large error, which makes it possible to realize a structure in which the capability signal Sa is not held. In addition, it is preferable to hold both the output current detecting signal Si and the capability signal Sa.

When the operation of the power supply driving circuit Ug stops in the state in which the current breaking switch circuit SWs is turned off, charging or discharging of the capacitor Cx is not performed, so that the lamp voltage detecting signal Sv detected and generated by the lamp voltage detecting unit Vx substantially is held in the state at the time immediately before the current breaking switch circuit SWs was turned off. Therefore, it is considered that the output current target signal St also is held in the state at the time immediately before the current breaking switch circuit SWs is turned off.

Since the output current detecting signal Si or the lamp voltage detecting signal Sv fluctuates, it is not assured that the output current modulation instruction signal Sq is activated in a state in which the error of the output current detecting signal Si with respect to the output current target signal St is zero. When the error occurs in a period where the output current modulation instruction signal Sq is in an active state, it takes much time to return the output current modulation instruction signal Sq from the inactive state to the original state. In particular, when the output current error calculating circuit Ud performs the operation of an integral circuit, this effect becomes more remarkable. Further, it is also preferable that the power control circuit Up hold the output state of the output current target signal St in a period where the output current modulation instruction signal Sq is in active state.

Furthermore, in this embodiment, in order to hold the output current target signal St, the operation of the power control circuit Up which generates the output current target signal St is controlled by using the output current target holding signal Smt. However, any method may be used as long as it can hold the output current target signal St. For example, similar to the structure in which the lamp-current-detecting-signal holding circuit Usi is provided to hold the signal detected by the output current detecting unit Ix, a lamp-voltage-detecting-signal holding circuit for holding the signal detected by the lamp voltage detecting unit Vx may be provided to hold the lamp voltage detecting signal Sv.

As described above, in the discharge lamp lighting device of the invention shown in FIG. 1, when the lamp current is broken, the current breaking switch circuit SWs connected in series to the discharge lamp Ld is turned off or on by controlling an output current modulation instruction signal Sq to be active or inactive, without waiting for the response of a delay circuit, such as a microprocessor or a complicated power control feedback loop. Therefore, it is possible to rapidly break the lamp current and to rapidly release the breaking of the lamp current. Further, since the discharge lamp lighting device is operated without waiting for the response of a circuit having internal timing, such as a microprocessor or a converter, delay in operation is reduced to the minimum, so that jitter does not occur.

Furthermore, the capacitor Cx provided at the output terminals of the power supply circuit Ux is not charged by stopping the operation of the converter Uc in a state in which the current breaking switch circuit SWs is turned off, so that the output voltage of the power supply circuit Ux does not vary. In addition, the output signal of the output current error calculating circuit Ud or the output current detecting signal Si is held, so that the state of a feedback control loop does not vary. Therefore, after the current breaking switch circuit SWs is turned on, the current flowing through the discharge lamp rapidly returns to the value which was obtained immediately before the current breaking switch circuit SWs was turned off, so that lighting of the lamp can be resumed. Thus, it is possible to solve the problems in that the lamp current slowly returns to the value, the lamp current returns to the value after an excessively large amount of current flows one time, and the lamp current returns to the value in a damped oscillation manner.

When the breaking operation is performed beyond the predetermined time which depends on the specification thereof, the lamp may not be turned on. For example, in a case of a high-pressure mercury lamp having specification in which a distance between electrodes is smaller than 2 mm, the amount of sealed mercury is more than 0.15 $mg/mm^3$, the amount of sealed halogen is more than $1\times10^{-6}$ to $1\times10^{-2}$ $micromol/mm^3$, and the maximum breaking time is 4 ms.

When the lamp current needs to be broken for a long time for which the above-mentioned phenomenon may occur, it is necessary to provide a temporary booster unit Uh for temporarily raising a voltage to be applied to the discharge lamp Ld in order to avoid the above-mentioned phenomenon, as shown in the broken lines in FIG. 1. When the output current modulation instruction signal Sq returns to the inactive state, the modulation control signal generating circuit Um turns on the current breaking switch circuit SWs and outputs a temporary booster unit trigger signal Smh for operating the temporary booster unit Uh. Then, the lamp voltage which has been charged in the capacitor Cx immediately before the current breaking switch circuit SWs was turned off and a voltage raised by the temporary booster unit Uh is applied to the discharge lamp Ld.

Although the conditions of the voltage to be applied in this case depend on the specification of the lamp and the breaking time of the current breaking switch circuit SWs, it is effective to use a pulse voltage with a half power width of about 100 ns which has a peak voltage as high as a no-load open circuit voltage. For example, in general, the high-pressure mercury lamp having the above-mentioned specification has a normal lamp voltage of about 100 V and a no-load open circuit voltage of about 300 V. In addition, if the temporary booster unit Uh is not provided, a voltage of about 100 V is applied to the lamp when the current breaking switch circuit SWs is turned on. However, when the temporary booster unit Uh is provided, a voltage of about 300 V is applied thereto, which is preferable to improve the effects of the invention.

Next, FIG. 2 is a block diagram schematically illustrating a discharge lamp lighting device including a variable current control circuit SWb for bypassing some of the current components flowing through the discharge lamp Ld. The discharge lamp lighting device according to this embodiment will be described with reference to FIG. 2. In the discharge lamp lighting device shown in FIG. 2, the structure of a power supply circuit Ux is the same as that of the power supply circuit Ux shown in FIG. 1. However, the following structure can be omitted therefrom according to conditions: a modulation control signal generating circuit Um having the same structure as that shown in FIG. 1 is provided; and when the output current modulation instruction signal Sq is in an active state, the modulation control signal generating circuit Um activates the output current target holding signal Smt so as to hold the output current target signal St.

The discharge lamp lighting device shown in FIG. 2 is provided with the variable current control circuit SWb, a bypass current detecting unit Ib, and a current bypass control circuit Un, instead of the current breaking switch circuit SWs and the temporary booster unit Uh shown in FIG. 1.

The variable current control circuit SWb is composed of, for example, an FET and is connected in parallel to the discharge lamp Ld to bypass some of the current components flowing through the discharge lamp Ld. The bypass current detecting unit Ib detects a bypass current IB flowing through the variable current control circuit SWb to generate a bypass current detecting signal Sb. The current bypass control circuit Un receives the output current modulation instruction signal Sq, and controls a bypass current control signal Smb for controlling the operation of the variable current control circuit SWb such that the bypass current detecting signal Sb is substantially zero, that is, no current flows through the variable current control circuit SWb, when the output current modulation instruction signal Sq is in an inactive state.

Further, when the output current modulation instruction signal Sq is in an active state, the current bypass control circuit Un controls the bypass current control signal Smb in a feedback manner such that, when the output current modulation instruction signal Sq is in the inactive state, a predetermined percentage of the current flowing through the discharge lamp Ld, flows through the variable current control circuit SWb, that is, the bypass current detecting signal Sb has a value obtained by multiplying the output current detecting signal Si by a proportional constant K.

In the above-mentioned structure, when output current modulation instruction signal Sq is in the inactive state, the whole output current IO from the power supply circuit Ux flows through the discharge lamp Ld, and the current of the discharge lamp Ld is controlled in a feedback manner such that the power consumed in the discharge lamp Ld is maintained in a target power value.

When the output current modulation instruction signal Sq is activated, a predetermined percentage of current flows through the variable current control circuit SWb in a pulse manner. In this case, since the converter Uc and a control circuit related to the capability control thereof are not operated, it is possible to rapidly control the current. As a result, it is possible to rapidly reduce the amount of current flowing through the discharge lamp Ld by the current flowing through the variable current control circuit SWb in a pulse manner.

When the output current modulation instruction signal Sq returns to the inactive state, the current of the variable current control circuit SWb is turned off. As a result, the current flowing through the discharge lamp Ld rapidly returns to the state at the time immediately before the output current modulation instruction signal Sq was activated, and the power consumed in the discharge lamp Ld is controlled in a feedback manner so as to be maintained in a target power value.

An HID lamp is characterized in that, even when a lamp current varies, a lamp voltage is little changed. That is, in the HID lamp, a substantially uniform lamp voltage is applied regardless of a flowing current, as in a Zener diode. However, since the uniform voltage is maintained for a short time, the voltage is greatly varied at low speed according to the lamp temperature which depends on the time passed from lighting of the lamp or the life span of the lamp.

Since the variable current control circuit SWb is provided in parallel to the discharge lamp Ld, the lamp voltage detecting signal Sv is approximately constant even when a current flows through the variable current control circuit SWb or is broken. Therefore, the output current target signal St generated on the basis of the lamp voltage detecting signal Sv is not approximately changed due to a variation in the active/inactive states of the output current modulation instruction signal Sq.

Finally, although the active/inactive states of the output current modulation instruction signal Sq is changed, the output current target signal St and the output voltage of the power supply circuit Ux do not vary, so that the states of the converter Uc and a control circuit related to the capability control thereof do not vary. Therefore, the following structure can be omitted where the above-mentioned approximation is established: a modulation control signal generating circuit Um having the same structure as that shown in FIG. 1 is provided; and when the output current modulation instruction signal Sq is in an active state, the modulation control signal generating circuit Um activates the output current target holding signal Smt so as to hold the output current target signal St.

As described above, in the discharge lamp lighting device of the invention shown in FIG. 2, when the lamp current is broken, the variable current control circuit SWb provided in parallel to the discharge lamp Ld bypasses the lamp current or releases the bypass of the lamp current by controlling the output current modulation instruction signal Sq to be active or inactive, without waiting for the response of a delay circuit, such as a microprocessor or a complicated power control feedback loop. Therefore, it is possible to rapidly reduce the lamp current and to rapidly restore the amount of the lamp current to the value which was obtained before the reduction. Further, since the discharge lamp lighting device is operated without waiting for the response of a circuit having internal timing, such as a microprocessor or a converter, delay in operation is reduced to the minimum, so that jitter does not occur.

Furthermore, a circuit comprises a fixed resistor and a switching element connected in series to each other may be provided in parallel to the lamp in order to reduce the lamp current, and the current may be bypassed by turning on the switching element. In this embodiment, the reason why the bypass current detecting signal Sb is a value obtained by multiplying the output current detecting signal Si by the proportional constant K will be described below.

For example, the impedance of the discharge lamp varies with time due to a variation in the amount or components of a material sealed in a discharge space, a variation in the gap between the main discharge electrodes E1 and E2, change in the long-run consumption of the lamp, or a variation in the short term temperature change. In the discharge lamp having the characteristics in which impedance is not constant, the structure in which a current is bypassed to the fixed resistor provided in parallel to the lamp to reduce the lamp current has a problem in that power consumed in the lamp in case lamp current is reduced, that is, brightness of the lamp, depends on the impedance of the lamp at that time.

As described above, the discharge lamp is characterized in that the lamp voltage is approximately uniform. Therefore, the lamp current is reduced by a predetermined percentage of current by controlling the bypass current detecting signal Sb to be equal to a value obtained by multiplying the output current detecting signal Si by the proportional constant K, such that the power consumption of the lamp, that is, the brightness of the lamp, which is equal to the product of the lamp current and an approximately uniform lamp voltage, does not depend on the impedance of the lamp in the reduction state, thereby solving this problem.

When an excessively large percentage of current flows through the variable current control circuit SWb in a pulse manner, an excessively small amount of current flows through the discharge lamp Ld, which causes the accuracy of the approximation to be lowered. In this case, a little variation may occur in the output current target signal St due to a variation in the active/inactive states of the output current modulation instruction signal Sq. Therefore, the following structure is preferable: the modulation control signal generating circuit Um having the same structure as that shown in FIG. 1 is provided; and when the output current modulation instruction signal Sq is in an active state, the output current target holding signal Smt is activated to hold the output current target signal St.

In the above-mentioned structure, during the bypass of the lamp current by the variable current control circuit SWb, the output current target holding signal Smt is activated to hold the output current target signal St, so that the state of the feedback control loop is not changed. Therefore, after the bypass of the lamp current by the variable current control circuit SWb is released, the lamp current rapidly returns to the state at the time immediately before the beginning of the bypass, and lighting of the lamp can be resumed. Thus, this structure can suppress the following phenomena to the minimum: the lamp current slowly returns to the state immediately before the beginning of the bypass; the lamp current returns to the state immediately before the beginning of the bypass after an excessively large amount of current flows one time; and the lamp current returns to the state immediately before the beginning of the bypass in a damped oscillation manner.

Further, as the method of holding the output current target signal St as described above, any method may be used as long as it can hold the output current target signal St.

Since the variable current control circuit SWb is a variable resistor, power is consumed and heat is generated for a period of time for which a current flows through the variable resistor. It is assumed that the output current modulation instruction signal Sq is a pulse having a short time width and the variable current control circuit SWb has a heat dissipation mechanism. In this case, when the active state of the output current modulation instruction signal Sq lasts for an excessively long time or when the output current modulation instruction signal Sq very frequently turns to the active state, the variable current control circuit SWb may be damaged due to a sharp rise in the internal temperature thereof. This is apt to occur when the output current modulation instruction signal Sq is supplied from the outside of the discharge lamp lighting device.

FIG. 3 shows the structure of an output current modulation instruction signal correcting circuit Uy for protecting the variable current control circuit SWb from being damaged. When an original output current modulation instruction signal Sqe with a positive logical value, which is supplied from the outside, is activated, charges are stored in a capacitor Cy1 through a buffer Gy01, a diode Dy1, and a charging resistor Ry1. As the active state of the original output current modulation instruction signal Sqe lasts for a longer time, or as the original output current modulation instruction signal Sqe more frequently turns to the active state, a higher voltage is formed at both ends of the capacitor Cy1. On the other hand, when the original output current modulation instruction signal Sqe is in an inactive state, the capacitor Cy1 is discharged through a diode Dy2 and a discharging resistor Ry2. As the inactive state of the original output current modulation instruction signal Sqe lasts for a longer time, or as the original output current modulation instruction signal Sqe more frequently turns to the inactive state, the capacitor Cy1 is more rapidly discharged, so that a voltage gradually approaches zero.

This circuit is considered as a simulation model in which the voltage of the capacitor Cy1 corresponds to an internal temperature value raised in the variable current control circuit SWb. Therefore, the following structure can be formed: the capacitance of the capacitor Cy1 and the resistance values of the charging resistor Ry1 and the discharging resistor Ry2 are suitably set; a comparator Cmy1 compares the voltage of a reference voltage signal source Vy1 having a voltage corresponding to the upper limit of the internal temperature value raised in the variable current control circuit SWb, with the voltage of the capacitor Cy1; and, as a result of comparison, only when the voltage of the capacitor Cy1 is lower than that of the reference voltage signal source Vy1, the comparator Cmy1 outputs a high-level signal. Then, a gate circuit Gy02 calculates the logical product of the output of the comparator Cmy1 and the original output current modulation instruction signal Sqe.

In the above-mentioned structure, when the internal temperature value raised in the variable current control circuit SWb is smaller than the upper limit, the original output current modulation instruction signal Sqe is transmitted as the output current modulation instruction signal Sq. On the other hand, when the raised internal temperature value of the variable current control circuit SWb is larger than the upper limit, operation is performed such that only the output current modulation instruction signal Sq, which is in an inactive state, is generated. Therefore, the active state of the output current modulation instruction signal Sq does not last for an excessively long time, or the output current modulation instruction signal Sq does not very frequently turn to the active state, and thus the variable current control circuit SWb is protected.

Figure 4:
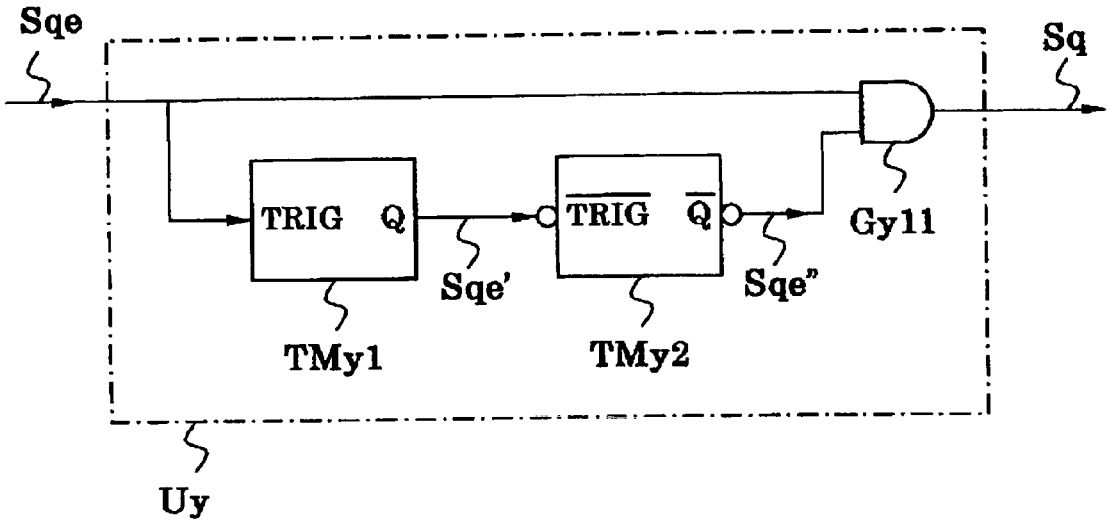
FIG. 4 is a diagram schematically illustrating another portion of the discharge lamp lighting device according to the embodiment of the invention.

FIG. 4 shows the structure of another output current modulation instruction signal correcting circuit Uy for protecting the variable current control circuit SWb from being damaged. The original output current modulation instruction signal Sqe with a positive logical value which is supplied from the outside is input to a timer circuit TMy1. The timer circuit TMy1 is composed of, for example, a monostable multivibrator for generating a positive logical pulse signal Sqe' having a predetermined time width $\tau w$ which corresponds to the upper limit value of a predetermined time for which the active state lasts. The timer circuit TMy1 is triggered at the rise of the input signal to be operated. Further, the pulse signal Sqe' is input to a timer circuit TMy2 for generating a negative logical pulse signal Sqe" having a predetermined time width $\tau p$ which corresponds to the lower limit value of a predetermined time for which the inactive state lasts. The timer circuit TMy2 is triggered at the fall of the input signal to be operated. A gate circuit Gy11 calculates the logical product of the original output current modulation instruction signal Sqe and the pulse signal Sqe" to generate the output current modulation instruction signal Sq.

Figure 5:
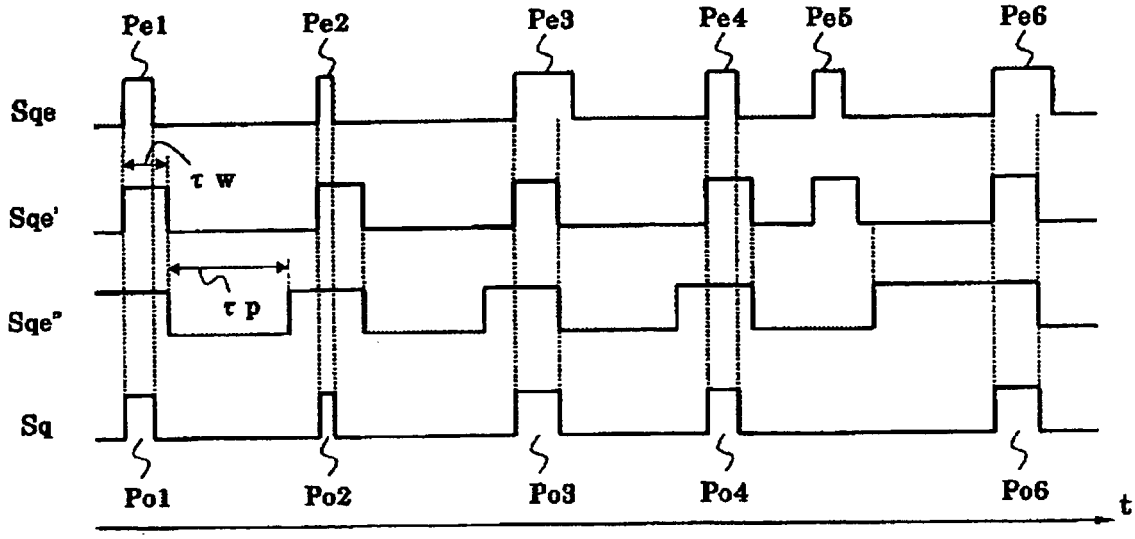
FIG. 5 is a timing chart of another portion of the discharge lamp lighting device according to the embodiment of the invention.

FIG. 5 shows an example of a timing chart related to the circuit shown in FIG. 4. Pulses Pe1, Pe2, and Pe4 of the original output current modulation instruction signal Sqe are output as pulses Po1, Po2, and Po4 of the output current modulation instruction signal Sq since they are within the periods where the pulse signal Sqe" is at a high level. Pulses Pe3 and Pe6 of the original output current modulation instruction signal Sqe have a portion beyond the period where the pulse signal Sqe" is at the high level since they exceed the upper limit value of the predetermined time for which the active state lasts. Therefore, the pulses Pe3 and Pe6 are output as pulses Po3 and Po6 of the output current modulation instruction signal Sq, with the exceeded portions being removed. A pulse Pe5 of the original output current modulation instruction signal Sqe is generated in a period where the pulse signal Sqe" is at a low level since it has the lower limit value of the predetermined time for which the inactive state lasts. Therefore, the entire output current modulation instruction signal Sq is removed.

As such, when portions of or all the pulses of the original output current modulation instruction signal Sqe are beyond the range of a predetermined lower limit value to a predetermined upper limit value, the portions of or all the pulses beyond the range are removed. In addition, during periods corresponding to the removed portions, no current flows through the variable current control circuit SWb, so that the variable current control circuit SWb is protected.

The circuit shown in FIG. 4 has a function for removing the exceeded portions to use it as the output current modulation instruction signal Sq when portions of the time for which the original output current modulation instruction signal Sqe is in an active state exceed a predetermined upper limit value; and a function for removing the periods where the frequency of active states of the original output current modulation instruction signal Sqe exceeds a predetermined upper limit value and for using it as the output current modulation instruction signal Sq. If the former function is not needed, the timer circuit TMy1 may be removed, and the original output current modulation instruction signal Sqe may be directly input to the timer circuit TMy2. In addition, if the former function is not needed, the timer circuit TMy2 may be removed, and the pulse signal Sqe' output from the timer circuit TMy1 may be directly input to the gate circuit Gy11.

In this embodiment, the timer circuit TMy2 related to the predetermined lower limit value of inactive state period is controlled to protect the variable current control circuit SWb against the original output current modulation instruction signal Sqe having the frequency of active states higher than the predetermined upper limit value. However, the higher the frequency of active states is, the shorter the inactive state period becomes. Therefore, the circuit shown in FIG. 4 protects the variable current control circuit Swb against the original output current modulation instruction signal Sqe having the frequency of active states higher than the predetermined upper limit value. As such, if the protection can be performed in a case the frequency of active states of the original output current modulation instruction signal Sqe exceeds the predetermined upper limit value, control can be executed on the basis of an arbitrary amount corresponding to the frequency of the original output current modulation instruction signal Sqe.

Figure 6:
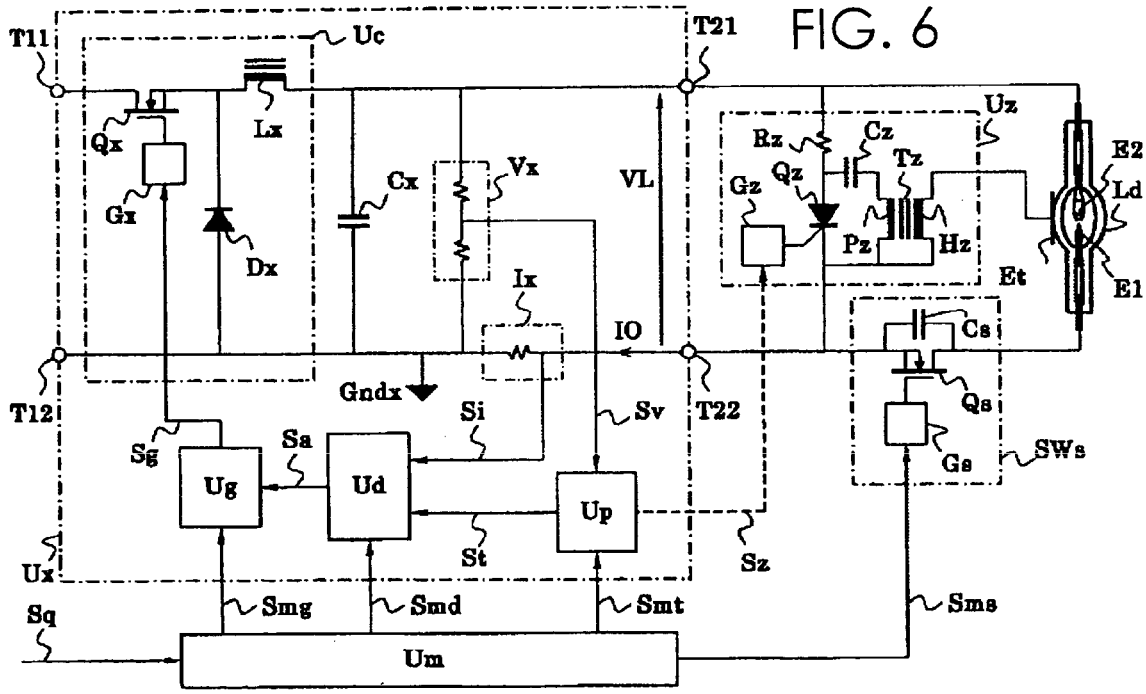
FIG. 6 is a block diagram schematically illustrating a discharge lamp lighting device using a DC driving method according to an embodiment of the present invention.

Next, this embodiment of the invention will be described with reference to the drawings illustrating the structure thereof in more detail. FIG. 6 is a block diagram schematically illustrating an example of the structure of a discharge lamp lighting device including a current breaking switch circuit SWs for interrupting a current flowing through the discharge lamp Ld, which corresponds to that shown in FIG. 1, and the discharge lamp lighting device is driven by a DC driving method.

In the discharge lamp lighting device according to the invention, a power supply circuit Ux using a step-down chopper type converter Uc of as a main unit receives a voltage from a DC power supply, such as a PFC, through its terminals T11 and T12 to adjust the amount of current to be applied to the discharge lamp Ld. In the power supply circuit Ux, a switching element Qx, such as an FET, turns on/off a current from the DC power supply, and the current flows through a choke coil Lx to be charged in a capacitor Cx. When the switching element Qs of the current breaking switch circuit SWs is in an on state, a voltage is applied to the discharge lamp Ld to cause a current to flow through the discharge lamp Ld. In this structure, an overvoltage protecting capacitor Cs is provided in parallel to the switching element Qs.

Further, in the period where the switching element Qx is an on state, the current flowing through the switching element Qx is directly charged in the capacitor Cx and is also supplied to the discharge lamp Ld, which is a load. In addition, energy is accumulated in the choke coil Lx in the form of magnetic flux. On the other hand, when the switching element Qx is an off state, the energy accumulated in the choke coil Lx in the form of magnetic flux causes a current to be charged in the capacitor Cx through a flywheel diode Dx and to be supplied to the discharge lamp Ld.

In the step-down chopper type power supply circuit Ux, the amount of current to be supplied to the discharge lamp can be adjusted on the basis of the ratio at a period during which the switching element Qx is an on state to a period during which the switching element Qx is operated, that is, on the basis of a duty cycle ratio. In this embodiment, a gate driving signal Sg having a predetermined duty cycle ratio is generated by a power supply driving circuit Ug and is supplied to a gate terminal of the switching element Qx through a gate driving circuit Gx to control the gate terminal, so that the current supply from the DC power supply is controlled.

In a starter circuit Uz, a capacitor Cz is charged by an output voltage VO from the power supply circuit Ux through a resistor Rz. For example, when the starter circuit Uz receives a trigger signal Sz generated by, for example, a microprocessor unit Mpu, which will be described later, so that a gate driving circuit Gz is activated, a switching element Qz composed of, for example, a thyristor, is turned on to cause the capacitor Cz to be discharged through a primary coil Pz of a transformer Tz, so that a high-voltage pulse is generated in a secondary coil Hz. The high voltage generated in the secondary coil Hz of the starter circuit Uz is applied to a trigger electrode Et of the discharge lamp Ld to start discharge between the electrodes E1 and E2 of the discharge lamp Ld.

An output current detecting unit Ix and a lamp voltage detecting unit Vx detect the lamp current flowing between the electrodes E1 and E2 of the discharge lamp Ld, that is, the output current IO of the power supply circuit Ux, and a lamp voltage generated between the electrodes E1 and E2, that is, the output voltage VO of the power supply circuit Ux, respectively. The output current detecting unit Ix can be formed of a shunt resistor, and the lamp voltage detecting unit Vx can be formed of a resistor divider. An output current detecting signal Si from the output current detecting unit Ix is input to the output current error calculating circuit Ud, and a lamp voltage detecting signal Sv from the lamp voltage detecting unit Vx is input to a power control circuit Up.

Figure 7:
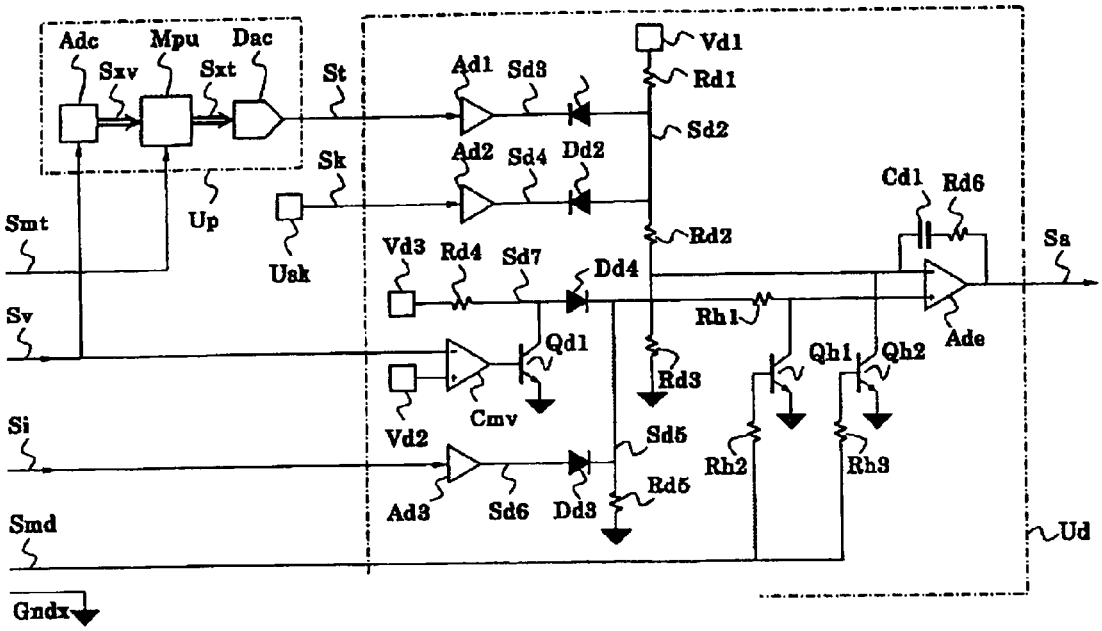
FIG. 7 is a diagram schematically illustrating a portion of the discharge lamp lighting device according to the embodiment of the invention.

FIG. 7 shows the schematic structure of the power control circuit Up and the output current error calculating circuit Ud shown in FIG. 6. The lamp voltage detecting signal Sv is input to an AD converter Adc of the power control circuit Up to be converted into digital lamp voltage data Sxv having a proper digit number, and the converted data is input to the microprocessor unit Mpu. In this embodiment, the microprocessor unit Mpu includes a CPU, a program memory, a data memory, a clock pulse generating circuit, a time counter, and an IO controller for inputting or outputting digital signals.

When the output current target holding signal Smt is in an inactive state, the microprocessor Mpu periodically updates chopper capability control target data Sxt for the output current error calculating circuit Ud, which will be described later, on the basis of calculation referring to lamp voltage data Sxt or the determination of conditions corresponding to the state at that time. The chopper capability control target data Sxt is converted into an analog output current target signal St by a DA converter Dac, and the converted signal is input to the output current error calculating circuit Ud.

Further, a lamp current upper limit signal Sk for defining an allowable upper limit value of the lamp current is generated by a lamp current upper limit signal generating circuit Usk, and is then input to the output current error calculating circuit Ud.

In the output current error calculating circuit Ud, the output current target signal St is supplied to one end of a pull-up resistor Rd1 through a buffer Ad1 or an amplifier, which may be provided if necessary, and a diode Dd1, and the lamp current upper limit signal Sk is supplied to the one end of the pull-up resistor Rd1 through a buffer Ad2 or an amplifier, which may be provided if necessary, and a diode Dd2. A chopper driving target signal Sd2 is generated on the basis of the two signals. In addition, the other end of the pull-up resistor Rd1 is connected to a reference voltage source Vd1 having a predetermined voltage. Further, the chopper driving target signal Sd2 is one of a signal Sd3 corresponding to the output current target signal St and a signal Sd4 corresponding to the lamp current upper limit signal Sk which has a small magnitude.

That is, for example, the power control circuit Up divides a constant corresponding to a rated voltage by the lamp voltage data Sxv to calculate the value of the lamp current for achieving the rated voltage, and generates the output current target signal St to correspond to the value by using an arbitrary method. In this structure, even when this is inappropriate, the output current error calculating circuit Ud controls the chopper driving target signal Sd2 in a hardware manner such that the lamp current does not exceed the lamp current upper limit signal Sk.

Further, control by the AD converter Adc or the microprocessor unit Mpu causes a low operational speed (or when the operational speed increases, a manufacturing cost rises). Therefore, for example, when the discharge state of the lamp is suddenly changed, the delay of operation causes the generation of an inappropriate output current target signal St. Thus, the function of limiting the current in a hardware manner is advantageous in protecting the lamp or the power supply device.

Meanwhile, the output current detecting signal Si is supplied to one end of a pull-down resistor Rd5 having the other end connected to the ground Gndx through a buffer Ad3 or an amplifier, which may be provided if necessary, and a diode Dd3, so that a control target signal Sd5 is generated.

Further, a comparator Cmv compares the lamp voltage detecting signal Sv with the voltage of a reference voltage source Vd2 having a voltage corresponding to the no-load open circuit voltage. As a result of comparison, when the lamp voltage detecting signal Sv is higher than the no-load open circuit voltage in level, a transistor Qd1 is turned off or becomes active, and a current flows from a proper voltage source Vd3 to the pull-down resistor Rd5 through a resistor Rd4 and a diode Dd4. As a result, the level of the control target signal Sd5 rises. On the other hand, when the lamp voltage detecting signal Sv is lower than the no-load open circuit voltage in level, the transistor Qd1 is turned on, and the current from the voltage source Vd3 is interrupted, causing the control target signal Sd5 to correspond to the output current detecting signal Si. In a circuit composed of the pull-down resistor Rd5, the diode Dd3, and the diode Dd4, one of the signals Sd6 and Sd7, having a higher level, on the anode sides of the two diodes is selected, and a voltage corresponding to the selected signal is generated at both ends of the pull-down resistor Rd5.

According to this structure, in a case most of the output current is broken and almost all the output current detecting signals Si are not input, when the lamp voltage detecting signal Sv is higher than the no-load open circuit voltage in level, the control target signal Sd5 suddenly rises. Therefore, in general, the lamp voltage VL is controlled to be substantially lower than the no-load open circuit voltage in a hardware manner.

The chopper driving target signal Sd2 is divided by the resistors Rd2 and Rd3 and is then input to an inverting input terminal of an operational amplifier Ade. Meanwhile, the control target signal Sd5 is input to a non-inverting input terminal of the operational amplifier Ade through the resistor Rh1. When transistors Qh1 and Qh2 are turned off, an output signal of the operational amplifier Ade, that is, the capability signal Sa is fed back to the inverting input terminal through an integral capacitor Cd1 and a speed-up resistor Rd6. Therefore, the operational amplifier Ade serves as an error integrating circuit for integrating a difference between a voltage obtained by dividing the chopper driving target signal Sd2 by the resistors Rd2 and Rd3 and the voltage of the control target signal Sd5.

Figure 8:
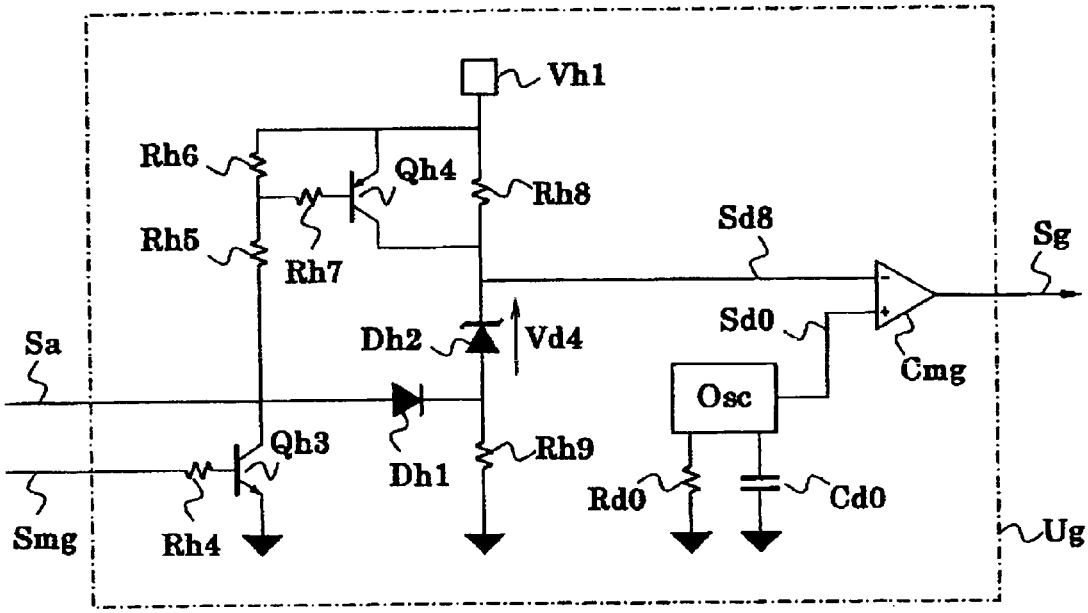
FIG. 8 is a diagram schematically illustrating another portion of the discharge lamp lighting device according to the embodiment of the invention.

FIG. 8 shows the schematic structure of the power driving circuit Ug shown in FIG. 6. An oscillator Osc connected to a capacitor Cd0 and a resistor Rd0 for determining a time constant generates a sawtooth wave signal Sd0 shown in 'a' of FIG. 9, and a comparator Cmg compares the sawtooth wave signal Sd0 with the capability signal Sa input from the output current error calculating circuit Ud.

In this case, the sawtooth wave signal Sdo is compared with a signal Sd8 obtained by adding the capability signal Sa to an offset voltage Vd4. The reason thereof will be described below. That is, when a transistor Qh4 is turned off, the capability signal Sa flows to a resistor Rh9 through a diode Dh1. Then, a voltage substantially equal to the capability signal Sa is generated at both ends of the resistor Rh9, and a current flows from a reference voltage source Vh1 having a predetermined voltage to the resistor Rh9 through a resistor Rh8 and a Zener diode Dh2. Therefore, the voltage signal Sd 8 at a cathode terminal of the Zener diode Dh2 is obtained by adding the capability signal Sa to the offset voltage Vd4 by a Zener voltage of the Zener diode Dh2.

A high-level gate driving signal Sg is generated in a period during which the voltage of the sawtooth wave signal Sd0 is higher than the voltage of the signal Sd8, and is output from the output current error calculating circuit Ud. As described above, the signal Sd8 is obtained by adding the offset to the capability signal Sa. Therefore, even if the capability signal Sa is zero, the duty cycle ratio of the gate driving signal Sg has a maximum value smaller than a one-hundred percent of duty cycle ratio, that is, the duty cycle ratio is smaller than a maximum duty cycle ratio DXmax. In FIG. 9, 'a' and 'b' show the relationship among the capability signal Sa, the signal Sd8 obtained by adding an offset to the capability signal Sa, the sawtooth wave signal Sd0, and the gate driving signal Sg.

When the gate driving signal Sg output from the power supply driving circuit Ug is input to the gate driving circuit Gx, the output current detecting signal Si and the lamp voltage detecting signal Sv are fed back to the switching element Qx, so that a feedback control system is formed. In addition, in the output current error calculating circuit Ud shown in FIG. 7, an integrated circuit of the operational amplifier Ade, the oscillator Osc, and the comparator Cmg which is obtainable from the market, (for example, TL494 manufactured by TEXAS INSTRUMENTS INCORPORATED).

FIG. 10 shows the schematic structure of an example of the temporary booster unit Uh. A capacitor Ch is charged by the output voltage Vo of the power supply circuit Ux through the resistor Rh. When the temporary booster unit Uh receives the temporary booster unit trigger signal Smh to activate the gate driving circuit Gh when the current breaking switch circuit SWs is turned on, a switching element Qh composed of, for example, a thyristor is turned on to cause the capacitor Ch to be discharged through a primary coil Ph of a transformer Th, so that a pulse is generated in a secondary coil Sh. This pulse overlaps the output voltage VO of the power supply circuit Ux and is then applied to the discharge lamp Ld.

Figure 11:
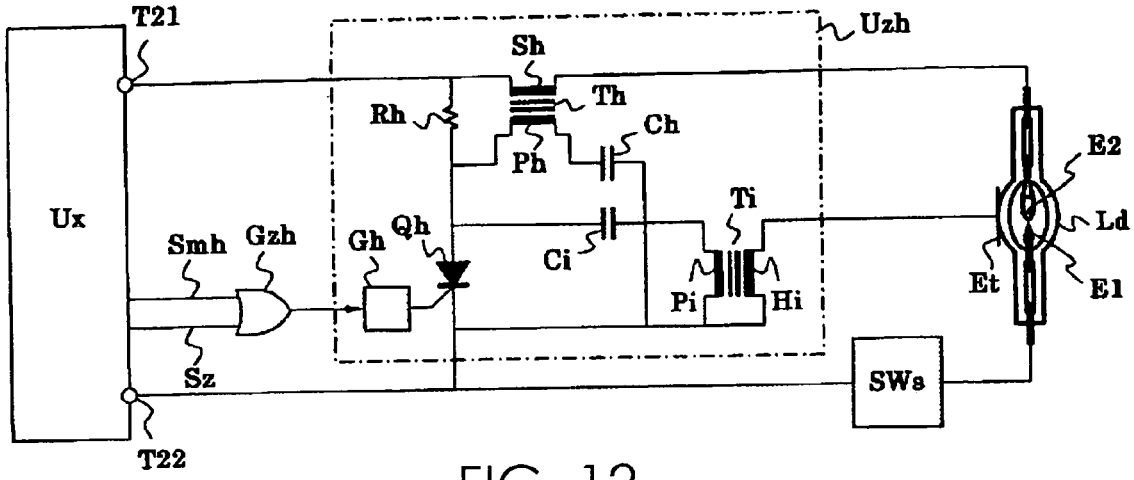
FIG. 11 is a diagram schematically illustrating a discharge lamp lighting device according to an embodiment of the invention.

As in a circuit Uzh shown in FIG. 11, the temporary booster unit Uh shown in FIG. 10 can be combined with the starter circuit Uz shown in FIG. 6, so that a common switching element Qh and a common gate driving circuit Gh can be used. A logical sum gate Gzh calculates the logical sum of the trigger signal Sz for operating the starter and the temporary booster unit trigger signal Smh, which makes it possible to operate the gate driving circuit Gh when one of the trigger signal Sz and the temporary booster unit trigger signal Smh is activated.

When the lamp is tuned on, the output voltage VO of the power supply circuit Ux is a no-load open circuit voltage and has a relatively high level of about 300 V. On the other hand, when the current breaking switch circuit SWs is turned on, the output voltage VO of the power supply circuit Ux is a normal lamp lighting voltage and has a relatively low level of about 100 V. Therefore, it is necessary to determine constants of circuit elements for operating the starter, such as the capacitor Cz and the transformer Tz, on the basis of the output voltage VO of the no-load open circuit voltage, and to determine constants of circuit elements for operating the temporary booster unit, such as the capacitor Ch and the transformer Th, on the basis of the output voltage VO of the normal lamp lighting voltage.

However, in this structure, a pulse voltage of the temporary booster unit is applied to the discharge lamp Ld at the time of start. However, since this operation is useful for an easy start, this structure does not matter. Further, when the current breaking switch circuit SWs is turned on, a voltage is generated at the transformer Tz. In this case, as described above, since the output voltage VO of the power supply circuit Ux is lower than a voltage required for operating the starter and thus is unavailable, this structure does not matter.

In order to generate no voltage at the transformer Tz when the current breaking switch circuit SWs is turned on, after the discharge lamp Ld is started, the primary coil Ph of the transformer Tz may be disconnected by the switching element, or the switching element may be turned off so that no current flows through the primary coil Ph.

Figure 12:
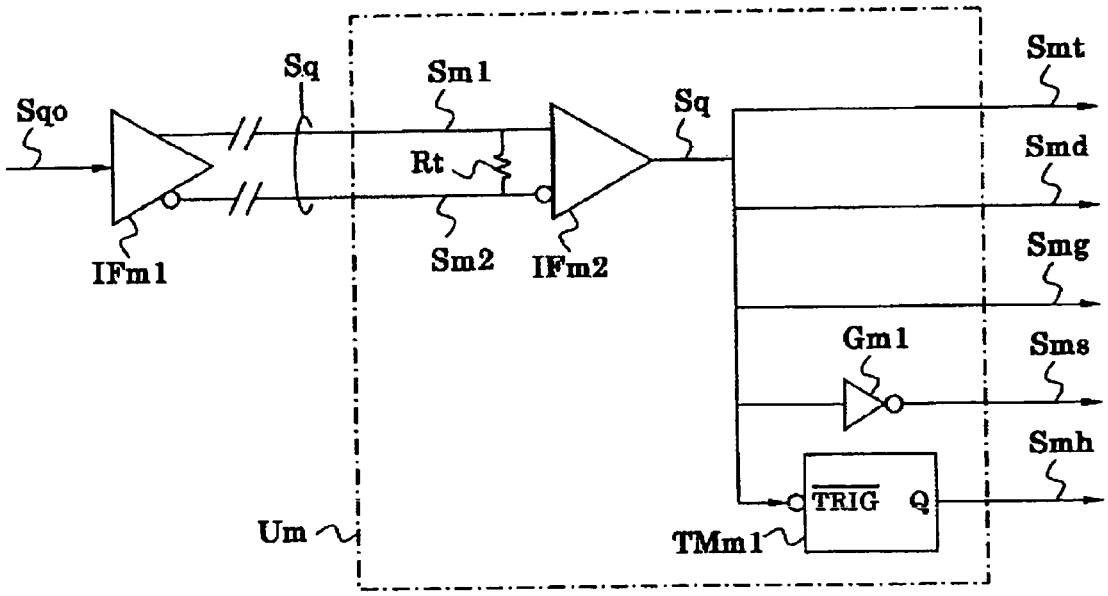
FIG. 12 is a diagram schematically illustrating a portion of the discharge lamp lighting device according to the embodiment of the invention.

FIG. 12 shows an example of the structure of an interface and a modulation control signal generating circuit Um when the output current error calculating circuit Sq is supplied from the outside. In FIG. 12, it is assumed that the output current modulation instruction signal Sq is a short pulse signal and a receiver IFm2 for performing differential balance communication is used as the interface element. In this case, the output current modulation instruction signal Sq is composed of two differential signals Sm1 and Sm2. The differential signals Sm1 and Sm2 are transmitted by a driver IFm1 for performing the differential balance communication. Further, an IC (for example, LTCl690 manufactured by LINEAR TECHNOLOGY CORPORATION), can be used as the driver IFm1 and the receiver IFm2. For example, in addition to the receiver IFm2, a high-speed photocoupler can be used as the interface element.

Furthermore, it is assumed that the output current modulation instruction signal Sq is in an active state at a high level and in an inactive state at a low level. In this case, when the output signal from the receiver IFm2 returns from an active state to an inactive state, a timer circuit TMm1 composed of, for example, a monostable multivibrator generates the temporary booster unit trigger signal Smh such that a high-level pulse having a predetermined time width. Meanwhile, in this structure, the output current target holding signal Smt, the capability holding signal Smd, and the power supply driving stop signal Smg are directly generated from the output signal of the receiver IFm2. The current breaking signal Sms is generated by logically inverting the output of the receiver IFm2 using a logic inverting gate Gm1. However, if necessary, a buffer, a logic inverting gate for matching logic, or a delay circuit for adjusting timing can be provided for these signals.

In the discharge lamp lighting device having the above-mentioned structure shown in FIG. 6, when the output current modulation instruction signal Sq is in an inactive state, the discharge lamp Ld is turned on, and a rated voltage is maintained by feedback control. When the output current modulation instruction signal Sq is activated, the output current target holding signal Smt, the capability holding signal Smd, the power supply driving stop signal Smg, and the current breaking signal Sms are activated.

When the output current target holding signal Smt is activated, the microprocessor unit Mpu stops updating the chopper capability control target data Sxt. As a result, the output current target signal St is held by the DA converter Dac.

In case that the capability holding signal Smd is activated, when a current flows to the transistors Qh1 and Qh2 through resistors Rh2 and Rh3, the transistors Qh1 and Qh2 are turned on, causing both the inverting input terminal and the non-inverting input terminal of the operational amplifier Ade to be connected to the ground. As a result, the error integrating circuit composed of the operational amplifier Ade stops the integrating operation. Therefore, the capability signal Sa, which is an output signal of the error integrating circuit, holds an integral value immediately before the capability holding signal Smd is activated.

When the power supply driving stop signal Smg is activated, a current flows to a transistor Qh3 through a resistor Rh4, causing the transistor Qh3 to be turned on, and a current flows to a resistor Rh6 through a resistor Rh5. Then, the current flows to the transistor Qh4 through a resistor Rh7 to cause the transistor Qh4 to be turned on. Therefore, the voltage of the signal Sd8 is raised to the voltage of the reference voltage source Vh1, resulting in a signal Sd8' having a level shown in a straight line of FIG. 9A. Thus, the duty cycle ratio of the gate driving signal Sg is forced to be reduced to zero, which causes the power supply driving circuit Ug to stop operating.

When the current breaking signal Sms is activated, the switching element Qs is turned off by the gate driving circuit Gs, so that the current of the discharge lamp Ld is rapidly broken. In the period where the current of the discharge lamp Ld is broken, the output current target signal St and the capability signal Sa are held, causing the operation of the power supply driving circuit Ug to stop. Therefore, the output voltage VO of the power supply circuit Ux is little changed.

When the output current modulation instruction signal Sq returns to the inactive state, the current breaking signal Sms is inactivated, and thus the breaking of the current of the discharge lamp Ld is rapidly released, causing the current of the discharge lamp to be restored to the original state. When the holding of the output current target signal St and the capability signal Sa is released, the power supply driving circuit Ug resumes operating. Therefore, the discharge lamp lighting device is controlled in a feedback manner such that the power consumption of the discharge lamp Ld is held in a target value.

FIG. 13 is a block diagram illustrating an example of the schematic structure of a discharge lamp lighting device according to the invention which corresponds to that shown in FIG. 2 and is driven by a DC driving method. The discharge lamp lighting device includes a variable current control circuit SWb for bypassing some of current components flowing through the discharge lamp Ld. FIG. 6 shows the discharge lamp lighting device provided with the starter circuit Uz using an external trigger method. However, FIG. 13 shows the discharge lamp lighting device provided with a starter circuit Uz' using an igniter method.

In the starter circuit Uz', a current is discharged in a capacitor Cz' through a resistor Rz' by the output voltage VO of the power supply circuit Ux. For example, when the starter circuit Uz' receives the trigger signal Sz generated by, for example, the microprocessor unit Mpu so that a gate driving circuit Gz' is activated, a switching element Qz' composed of, for example, a thyristor, is turned on to cause the capacitor Cz' to be discharged through a primary coil Pz' of a transformer Tz, so that a high-voltage pulse is generated in a secondary coil Hz'. The high voltage generated in the secondary coil Hz' of the starter circuit Uz' is applied between the electrodes E1 and E2 of the discharge lamp Ld, so that the discharge lamp starts discharging.

The structure of the power supply circuit Ux of the discharge lamp lighting device shown in FIG. 13 is the same as that of the power supply circuit Ux shown in FIG. 6. However, the following structure can be omitted: the modulation control signal generating circuit Um having the same structure as described above is provided; and when the output current modulation instruction signal Sq is in an active state, the modulation control signal generating circuit Um activates the output current target holding signal Smt so as to hold the output current target signal St.

Therefore, the functions in which the power control circuit Up, the output current error calculating circuit Ud, and the power supply driving circuit Ug shown in FIGS. 7 and 8 are controlled by the output current target holding signal Smt, the capability holding signal Smd, and the power supply driving stop signal Smg, respectively, can be omitted. FIG. 14 shows the structure of the power control circuit Up, the output current error calculating circuit Ud, and the power supply driving circuit Ug without having the above-mentioned functions.

Figure 15:
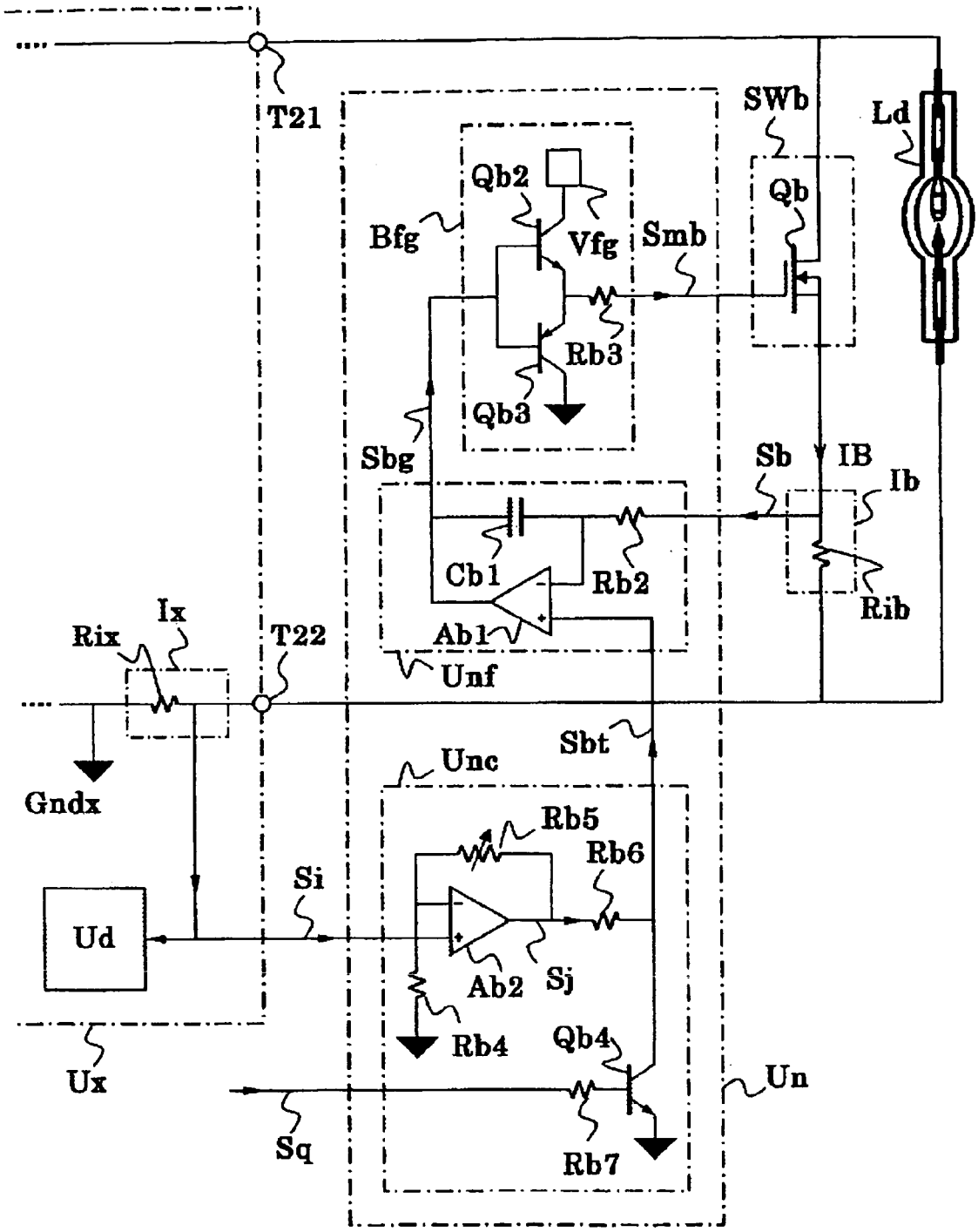
FIG. 15 is a diagram schematically illustrating a portion of the discharge lamp lighting device according to the embodiment of the invention.

FIG. 15 shows the schematic structure of a current bypass control circuit Un, a variable current control circuit SWb using, for example, an FET as a current control element Qb for controlling a current, and the periphery thereof. A bypass current detecting unit Ib composed of a resistor Rib detects a bypass current IB flowing through the variable current control circuit SWb to generate a bypass current detecting signal Sb. The bypass current detecting signal Sb is input to an inverting input terminal of an operational amplifier Ab1 through a resistor Rb2, and a bypass current target signal Sbt indicating a target value corresponding to the bypass current detecting signal Sb is input to a non-inverting input terminal of the operational amplifier Ab1. An original current control intensity signal Sbg output from the operational amplifier Ab1 is input to a gate terminal of the current control element Qb through a gate driving buffer Bfg including a buffer circuit composed of transistors Qb2 and Qb3, a power supply Vfg, and a gate resistor Rb3.

In this embodiment, the circuit structure related to the current control element Qb is generally called a source follower (an emitter follower in a case of a bipolar transistor). When the circuit structure is in an unsaturated connection state (which is called an active state) in which a source potential of the current control element Qb, that is, a voltage formed at an end of the resistor Rib connected to the variable current control circuit SWb is substantially equal to a gate potential of the current control element Qb, the current control element Qb automatically adjusts its impedance. However, since control characteristics of the FET have a non-linear characteristic, such as a gate offset, the operational amplifier Ab1 is operated so as to correct the non-linear control characteristic of the FET or the non-linear characteristic of the gate driving buffer Bfg by an error integral circuit formed by arranging a capacitor Cb1 in a feedback loop. Further, preferably, the capacitor Cb1 has a small capacitance value so as to satisfy a reduction in current required and a rapid restoring operation, but it may be omitted. When the capacitor Cb1 is not omitted, it is effective to provide a speed-up resistor in series to the capacitor Cb1 (similar to the integral capacitor Cd1 shown in FIG. 7).

The output current detecting signal Si generated by the resistor Rix, serving as the output current detecting unit Ix, is input to an non-inverting input terminal of the operational amplifier Ab2, and a signal obtained by dividing the output signal of the operational amplifier Ab2 by resistors Rb5 and Rb4 is input to a non-inverting input terminal thereof. Therefore, the operational amplifier Ab2 serves as a non-inverting amplifier which outputs a signal proportional to the output current detecting signal Si. The output signal of the operational amplifier Ab2 passes through a resistor Rb6, and the signal having passed through the resistor Rb6 serves as a bypass current target signal Sbt.

The output current modulation instruction signal Sq is input to a transistor Qb4 through a resistor Rb7. In this case, the output current modulation instruction signal Sq is in an active state at a low level. When the output current modulation instruction signal Sq is in an inactive state, the transistor Qb4 is turned on. Therefore, the bypass current target signal Sbt is fixed to about zero volt. When the output current modulation instruction signal Sq is activated, the transistor Qb4 is turned off. Therefore, the bypass current target signal Sbt is proportional to the output current detecting signal Si.

In a case in which the output current modulation instruction signal Sq is in an inactive state, the discharge lamp lighting device having the above-mentioned structure, shown in FIG. 13, is controlled such that no current flows through the current control element Qb, that is, the current control element Qb is turned off since the bypass current target signal Sbt, which is a control target value of the current flowing through the current control element Qb, is zero. Therefore, the entire output current IO of the power supply circuit Ux flows through the discharge lamp Ld to cause the discharge lamp Ld to be turned on in a normal mode. As a result, for example, a rated current is maintained by feedback control.

When the output current modulation instruction signal Sq is activated, the bypass current target signal Sbt, which is the control target value of the current flowing through the current control element Qb, is proportional to the output current detecting signal Si. Therefore, the current control element Qb is rapidly feedback-controlled in the current bypass control circuit Un such that a control target current flows, and the current flowing through the discharge lamp Ld is rapidly reduced by an amount of current flowing through the variable current control circuit SWb in a bypass manner.

In the discharge lamp lighting device shown in FIG. 13, the ground Gndx for signals is arranged on the side of the converter Uc rather than on the side of the output current detecting unit Ix. Therefore, the current control element Qb performs current control on a signal having a voltage drop by the resistor Rix, serving as the output current detecting unit Ix, and a voltage drop by the resistor Rib, serving as the bypass current detecting unit Ib, overlapping each other.

In this case, the voltage drop by the resistor Rix, that is, the output current detecting signal Si is proportional to the output current IO. Therefore, when the signal having the two voltage drops overlapping each other is controlled to a target value proportional to the output current detecting signal Si, the bypass current IB is also proportional to the output current detecting signal Si. The signal having the two voltage drops overlapping each other has an effect on the relationship between a proportional constant K of the bypass current with respect to the output current IO and a circuit constant, such as a resistance value, but it does not matter in practice.

If errors the relationship between the proportional constant K and the circuit constant, such as the resistance value, has a problem, it is possible to simply solve this problem by using the practical methods: a method of dividing the ground or a method of subtracting the output current detecting signal Si from the signal detected by the bypass current detecting unit Ib to generate the bypass current detecting signal Sb; and a method of providing the ground for signals between the output current detecting unit Ix and the bypass current detecting unit Ib to separately generate the output current detecting signal Si and the bypass current detecting signal Sb.

In the circuit structure shown in FIG. 15, the gain of the operational amplifier Ab2 is obtained by adding one to the ratio of the resistance value of the resistor Rb5 to the resistance value of the resistor Rb4, since it is a non-inverting amplifier. The bypass current target signal Sbt to be controlled is generated by inputting the output current detecting signal Si to the amplifier, and the output current detecting signal Si overlaps the bypass current detecting signal Sb to be control. Therefore, since the overlapping value corresponds to the obtained gain to which one is added, the current bypass control circuit Un performs feedback control such that the bypass current Ib is proportional to the resistance value of the resistor Rb5.

As described above, the proportional constant K depends on the circuit constant, such as the resistance value. For example, in the circuit shown in FIG. 15, a variable resistor can be used as the resistor Rb5, and it is possible to arbitrarily set the value of the proportional constant K by adjusting the resistance value. However, this method is unsuitable for a structure in which the setting of the discharge lamp lighting device is dynamically changed during operation or a structure in which the optimum conditions of an optical device provided with the discharge lamp lighting device are automatically set according to usage conditions.

In order to change the setting of the proportional constant K on the basis of a signal input from the outside, the current bypass control circuit Un may further include a detected current signal converting circuit Ai for converting the bypass current detecting signal Sb or the output current detecting signal Si. The detected current signal converting circuit Ai includes a plurality switches Z0, Z1, . . . , Zn whose on or off states are controlled corresponding to a true or fault value of each of natural-number-bit binary conversion gain signals M0, M1, . . . , Mn, and the gain is varied by a combination of true and fault values of each of the conversion gain signals M0, M1, . . . , Mn.

Figure 16:
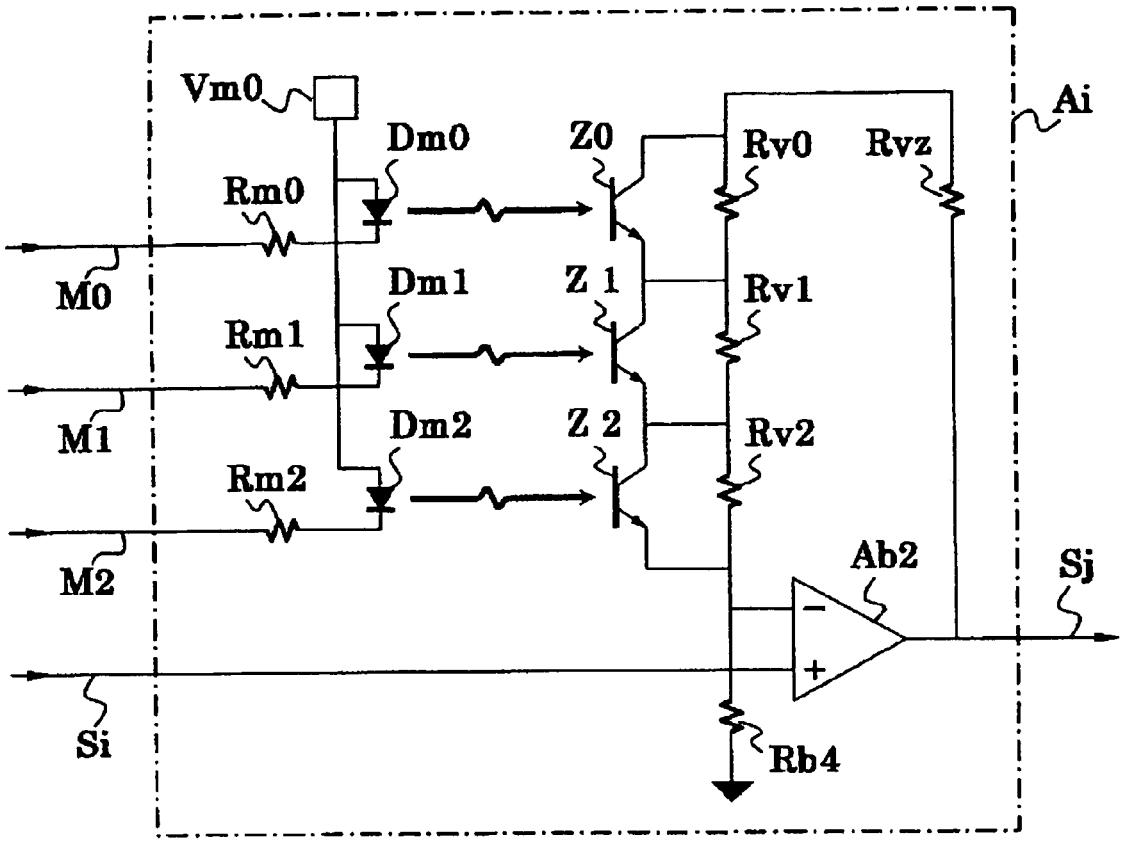
FIG. 16 is a diagram schematically illustrating a portion of the discharge lamp lighting device according to the embodiment of the invention.

FIG. 16 shows an example of a circuit structure in which the proportional constant K is added to the operational amplifier Ab2 shown in FIG. 15, on the basis of the signal input from the outside of the discharge lamp lighting device, in order to change the setting thereof. More specifically, resistors Rv0, Rv1, and Rv2 connected to each other in series are used instead of the resistor Rb5, and switches Z0, Z1, and Z2 composed of photocoupler transistors are connected in parallel to the resistors Rv0, Rv1, and Rv2, respectively. In this way, the operational amplifier Ab2 is used for a gain-variable non-inverting amplifier circuit as the detected current signal conversing circuit Ai for converting the output current detecting signal Si.

The on or off state of each of the switches Z0, Z1, and Z2 composed of photocoupler transistors can be set by controlling the flow of a current to photocoupler LEDs Dm0, Dm1, and Dm2 having anodes connected to a power source Vm0 through resistors Rm0, Rm1, and Rm2, on the basis of the true or fault value of each of the 3-bit binary conversion gain signals M0, M1, and M2. Therefore, it is possible to control the connection of the resistors Rv0, Rv1, and Rv2 on the basis of the true or fault value of each of the conversion gain signals M0, M1, and M2.

For example, when the resistance value of the resistor Rv1 is set to be two times the resistance value of the resistor Rv0 and the resistance value of the resistor Rv2 is set to be two times the resistance value of the resistor Rv1, it is possible to set eight types of combined resistance values proportional to the magnitudes of the binary conversion gain signals M0, M1, and M2, on the basis of the logic of the DA converter. However, in the circuit structure shown in FIG. 16, a resistor Rvz is additionally provided to set the minimum value of the combined resistance value.

The conversion gain signals M0, M1, and M2 may be set by an external device, such as an optical device provided with a discharge lamp lighting device. Alternatively, the microprocessor unit Mpu may receive information from an external device through an interface, such as EIA232, and then may set the conversion gain signals M0, M1, and M2 on the basis of the received information.

In the discharge lamp lighting device having the above-mentioned structure, since the gain of the amplifier circuit composed of the operational amplifier Ab2 is changed on the basis of the conversion gain signals M0, M1, and M2, it is possible to change the setting of the proportional constant K on the basis of signals input from the outside. In addition, in this embodiment, the 3-bit binary conversion gain signals are used, but the invention is not limited thereto. Any binary conversion gain signals having arbitrary bits can be used.

Figure 17:
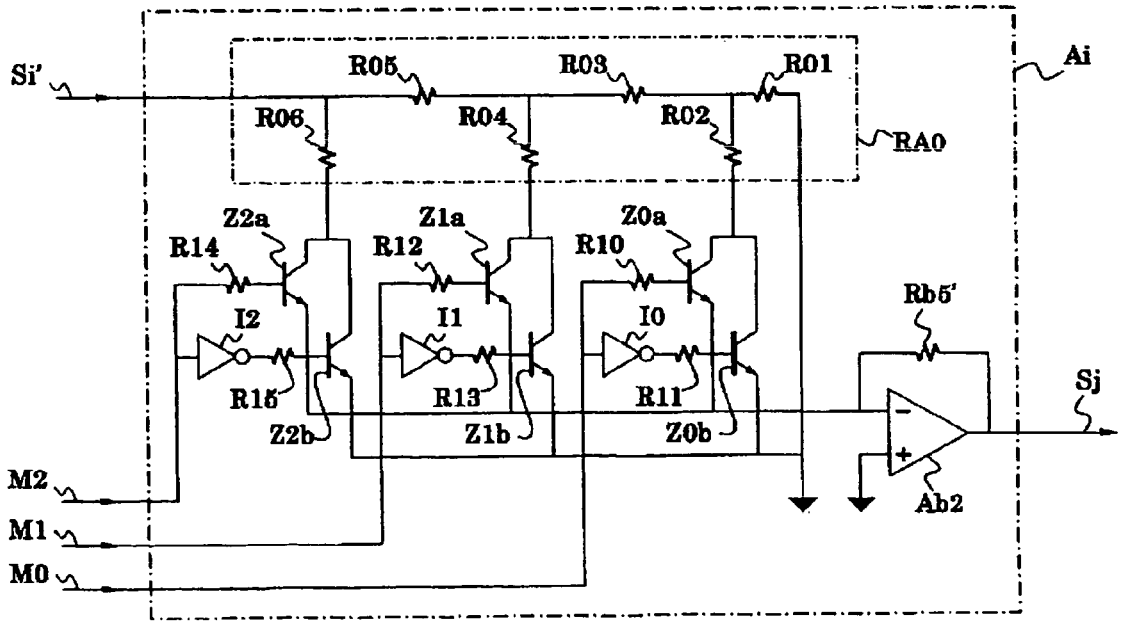
FIG. 17 is a diagram schematically illustrating a portion of the discharge lamp lighting device according to the embodiment of the invention.

FIG. 17 shows another example of the circuit structure in which the proportional constant K is added to the operational amplifier Ab2 shown in FIG. 15, on the basis of the signal input from the outside of the discharge lamp lighting device, in order to change the setting thereof.

In the detected current signal converting circuit Ai, switching elements Z0*a*, Z1*a*, and Z2*a* are provided such that their on and off states are controlled corresponding to the true and fault values of each bit of the conversion gain signals M0, M1, and M2, and logic inverting gates Io, I1, and I2 are connected to bases of switching elements Z0*b*, Z1*b*, and Z2*b*. Therefore, when one of the switching elements Z0*a* and z0*b* is in an on state, the other switching element is in an off state. When one of the switching elements Z1*a* and z1*b* is in an on state, the other switching element is in an off state. When one of the switching elements Z2*a* and Z2*b* is in an on state, the other switching element is in an off state.

In FIG. 17, the resistance values of resistors R03 and R05 are equal to each other, and the resistance values of resistors R01, R02, R04, and R06 are equal to each other, on the basis of the logic of the DA converter. Therefore, a ladder resistance network RA0 whose resistance value is two times the resistor R03 or R05 is used, which is preferable from the relation ship between the magnitudes of the binary conversion gain signals M0, M1, and M2 and conversion characteristics. Further, it is also possible to use a DA converting Ic.

Since the detected current signal converting circuit Ai shown in FIG. 17 is composed of an inverting amplifier, it can be applied to the circuit structure shown in FIG. 15. In this case, it is necessary to make the polarity of an output current detecting signal Si', which is an input signal of the detected current signal converting circuit Ai, reverse to that of the output current detecting signal Si by providing the ground for signals to the lamp rather than to the output current detecting unit Ix. Alternatively, the input signal or output signal may be inverted by using another inverting amplifier.

Figure 18:
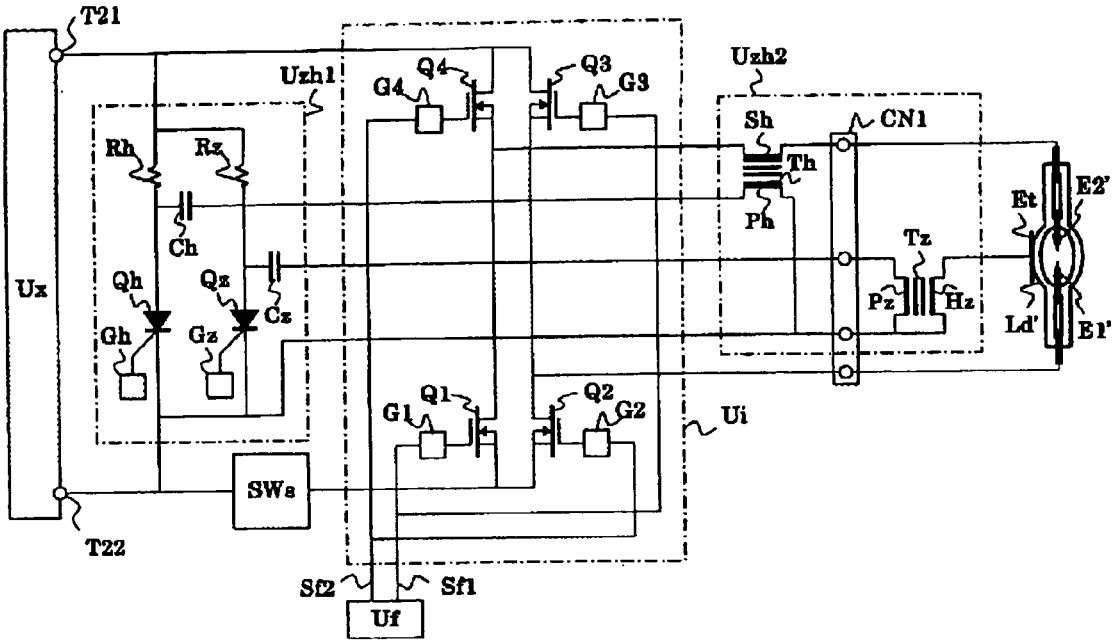
FIG. 18 is a diagram schematically illustrating a discharge lamp lighting device according to an embodiment of the invention.

Although the discharge lamp lighting device using the DC driving method has been described above, the invention can be used regardless of the type of the lamp. Therefore, the invention can be applied to a discharge lamp lighting device using an AC driving method. FIG. 18 shows an example of the schematic structure of a discharge lamp lighting device using the AC driving method according to the invention. The discharge lamp lighting device includes an inverter Ui of a full-bridge manner which is provided in the next stage of the power supply circuit Ux and a current breaking switch circuit SWs for breaking a current flowing a the discharge lamp Ld'.

Switching elements Q1, Q2, Q3, and Q4 composed of FETs are driven by gate driving circuits G1, G2, G3, and G4 corresponding thereto, and the gate driving circuits G1, G2, G3, and G4 are controlled by inverter control signals Sf1 and Sf2 output from an inverter control circuit Uf such that the switching elements Q1 and Q3 and the switching elements Q2 and Q4, which are diagonal elements of the full-bridge inverter, are turned on (saturated) at the same time. Dead time Td is set at portions where the active states of the inverter control signals Sf1 and Sf2 are switched to make them inactive, in order to prevent the switching elements Q1 and Q4 the switching elements Q2 and Q3, connected in series to each other, from being turned on at the same time so that a current does not flow therethrough at the same time. For example, a circuit shown in FIG. 21, which will be described later, can be used as the inverter control circuit Uf for generating these inverter control signals Sf1 and Sf2. This structure makes it possible to apply an alternating discharge voltage between main discharge electrodes E1' and E2' of the discharge lamp Ld', thereby lighting the discharge lamp Ld'.

The current breaking switch circuit SWs for breaking the current flowing through the discharge lamp Ld' may be provided between the power supply circuit Ux and the inverter Ui. Further, when the starter circuit Uz shown in FIG. 6 and the temporary booster unit Uh shown in FIG. 10 are mounted, the circuit structure shown in FIG. 18 may be divided into a primary circuit portion Uzh1 and a secondary circuit portion Uzh2. Then, the primary circuit portion Uzh1 may be mounted between the power supply circuit Ux and the current breaking switch circuit SWs, and the second circuit portion Uzh2 may be mounted between the inverter circuit Ui and the discharge lamp Ld'.

The reason why the circuit structure is divided into two portions is that, since a secondary circuit of the temporary booster unit generates a high voltage, the switching elements Q1, Q2, Q3, and Q4 of the inverter Ui may be damaged when the temporary booster unit is provided at the front state of the inverter Ui. In addition, the reason is that, since the primary circuit portion Uzh1 needs to receive DC power, it is preferable to provide the primary circuit portion Uzh1 at a position which is not affected by the state of the current breaking switch circuit SWs or by the phase of the inverter Ui. Further, for the starter circuit, a connecting terminal CN1 for connecting a circuit board and a lamp panel of the discharge lamp lighting device is preferably provided at the position shown in FIG. 18.

Figure 19:
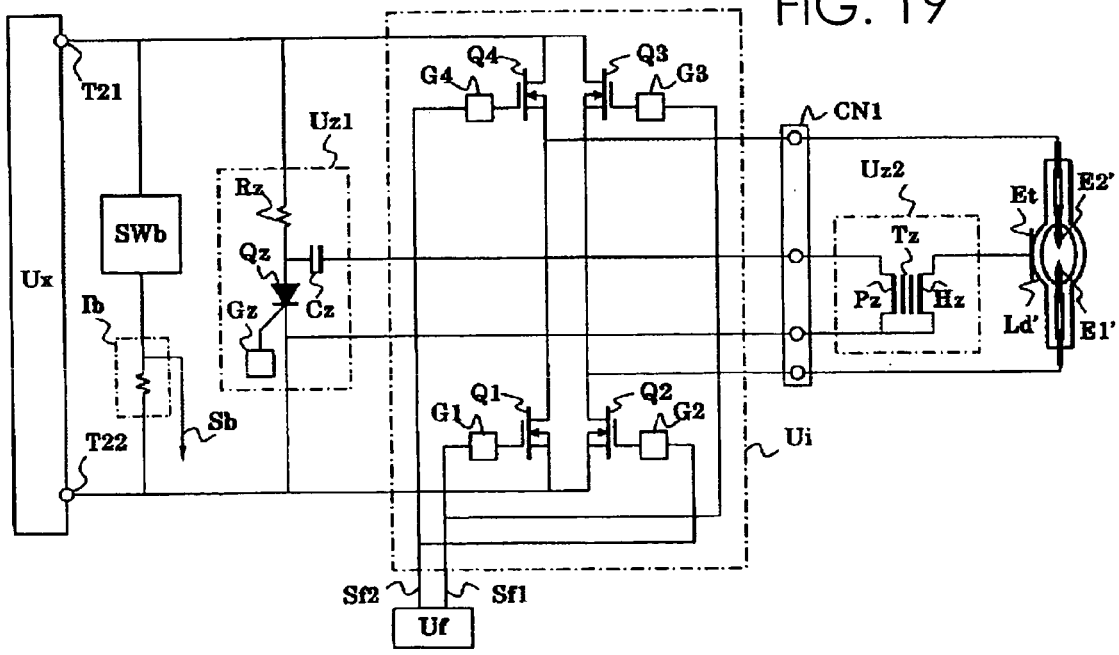
FIG. 19 is a diagram schematically illustrating a discharge lamp lighting device according to an embodiment of the invention.

FIG. 19 shows an example of the schematic structure of a discharge lamp lighting device using the AC driving method according to the invention. The discharge lamp lighting device includes an inverter Ui of a full-bridge manner which is provided in the next stage of the power supply circuit Ux and a variable current control circuit SWb which is provided between the power supply circuit Ux and the inverter Ui to bypass some of current components flowing through the discharge lamp Ld'.

The discharge lamp lighting device shown in FIG. 18 is formed by adding the inverter Ui to the discharge lamp lighting device shown in FIG. 1. In the discharge lamp lighting device, switching elements constituting the inverter Ui are also used as switching elements Qs of the current breaking switch circuit SWs for breaking the current flowing through the discharge lamp Ld', which makes it possible to reduce the manufacturing costs of a discharge lamp lighting device.

In order for the above-mentioned operation, the following structure is preferable: an inverter Ui for performing a repeatedly inverting operation, which includes switching elements for repeatedly inverting the polarity of a voltage applied to the discharge lamp Ld', is additionally provided in the next stage of the power supply circuit Ux; and when the output current modulation instruction signal Sq is activated, the modulation control signal generating circuit Um controls at least one of the switching elements of the inverter Ui which is in an on state for the repeatedly inverting operation to be off.

Figure 20:
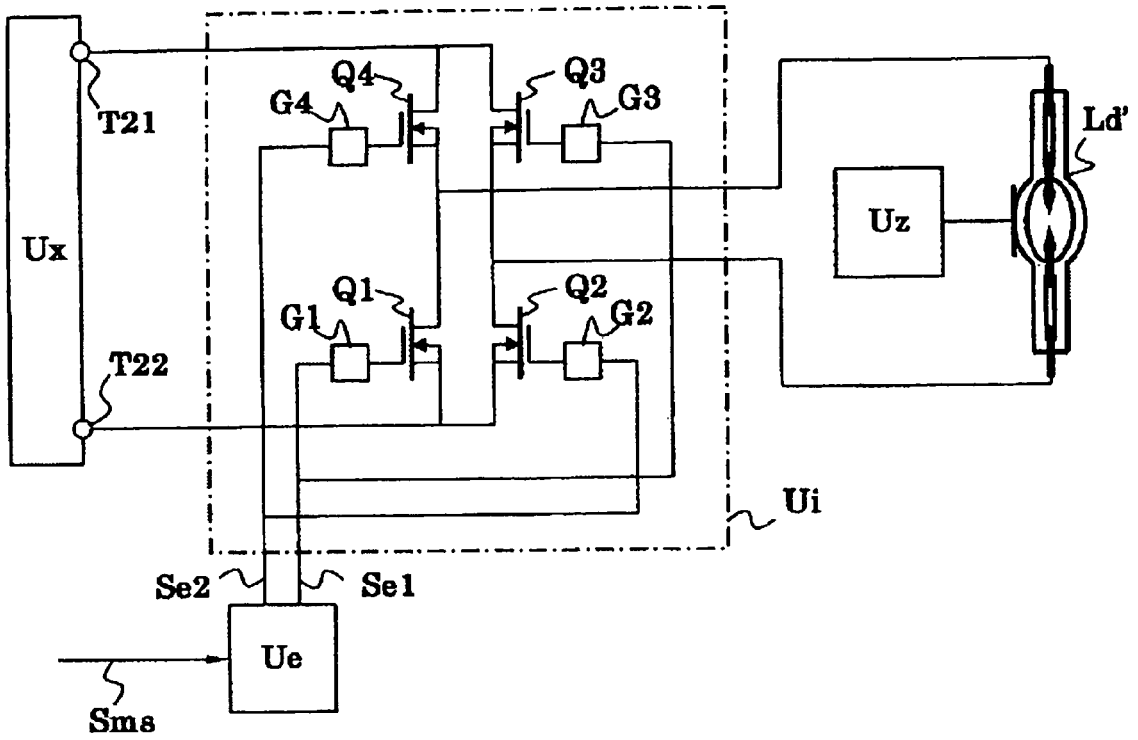
FIG. 20 is a diagram schematically illustrating a discharge lamp lighting device according to an embodiment of the invention.

FIG. 20 shows an example of the schematic structure of a discharge lamp lighting device using the AC driving method according to the invention. The discharge lamp lighting device includes the inverter Ui of a full-bridge manner which is provided in the next stage of the power supply circuit Ux. In the discharge lamp lighting device, switching elements Q1, Q2, Q3, and Q4 constituting the inverter Ui are also used as switching elements of the current breaking switch circuit SWs for breaking the current flowing through the discharge lamp Ld'. In addition, FIG. 21 shows the schematic structure of an inverter control circuit Ue of the discharge lamp lighting device.

Figure 21:
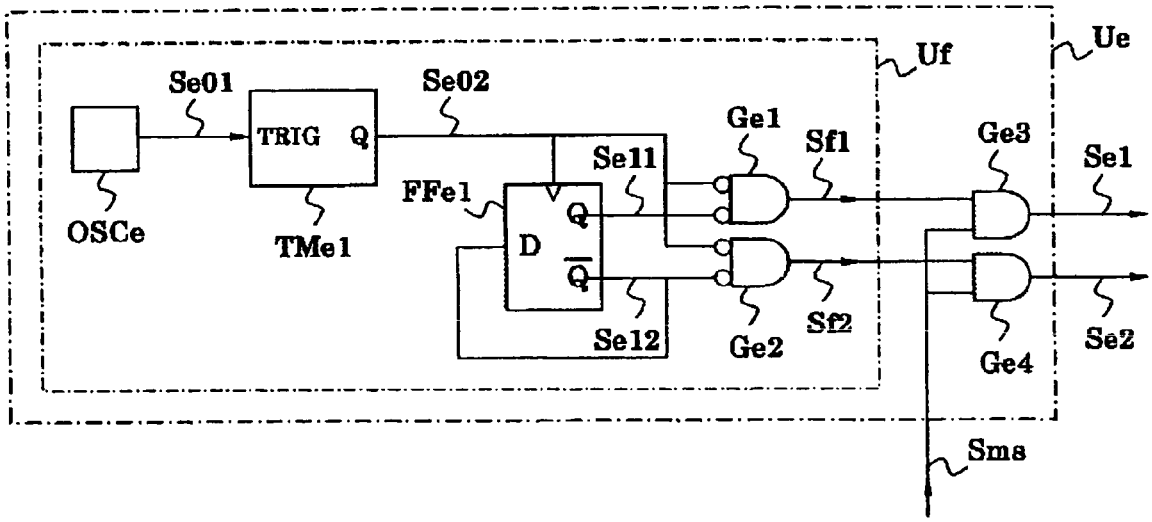
FIG. 21 is a diagram schematically illustrating a portion of the discharge lamp lighting device according to the embodiment of the invention.

In FIG. 21, a signal Se01 output from a polarity inversion instruction circuit OSCe for giving the polarity inversion timing of the inverter is input to a timer circuit TMe1 composed of, for example, a monostable multivibrator, and then the timer circuit TMe1 generates a signal Se02 corresponding to the dead time τd. The signal Se02 is input to a clock signal input of a delay flip-flop FFe1 having an input terminal connected to an inverting output terminal thereof. An output signal and an inverted output signal of the delay flip-flop FFe1 are respectively input to input terminals of NOR gates Ge1 and Ge2, and the signal Se02 is input to the other input terminals of the NOR gates Ge1 and Ge2.

Figure 22:
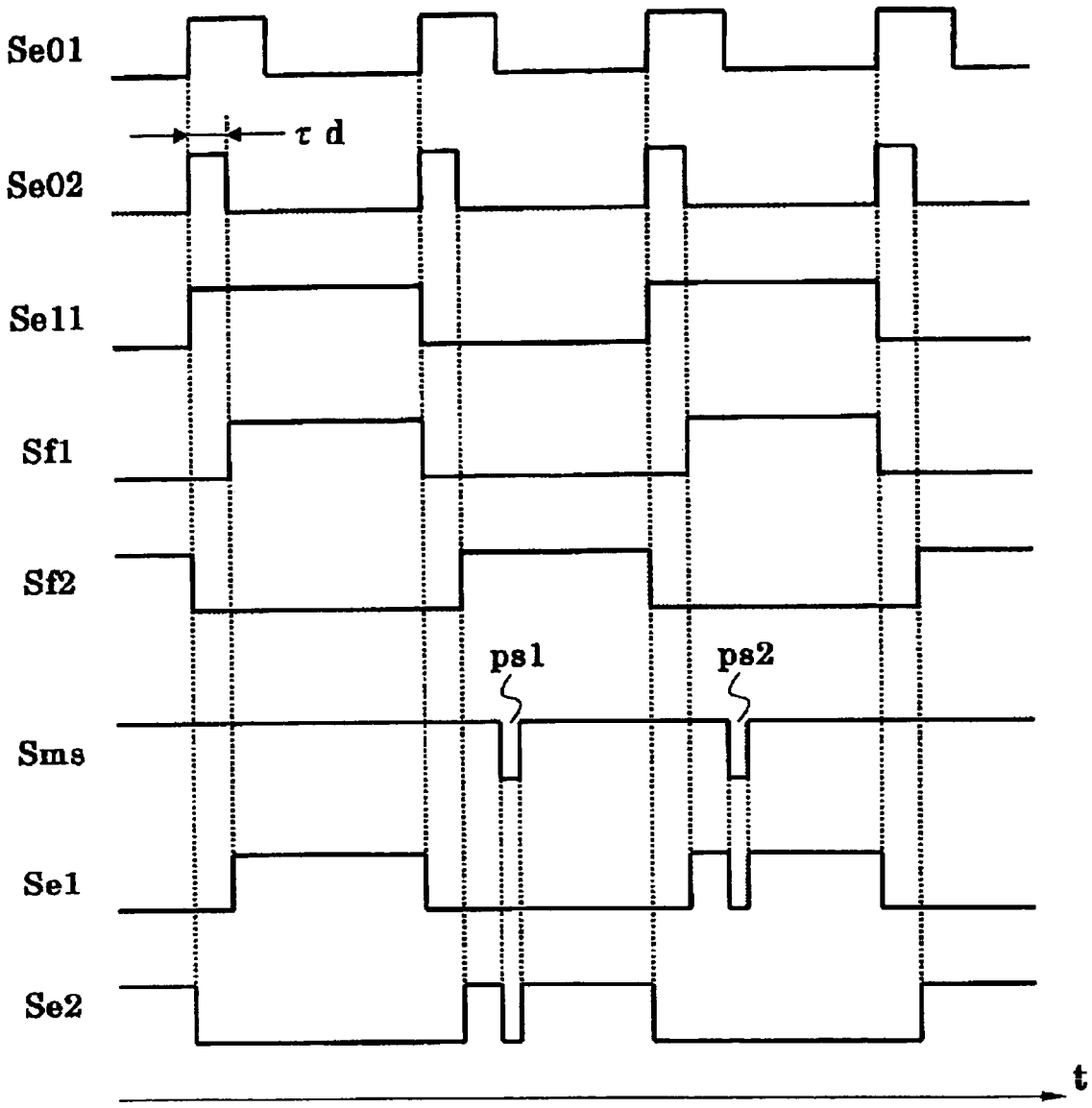
FIG. 22 is a timing chart of a portion of the discharge lamp lighting device according to the embodiment of the invention.

FIG. 22 is a timing chart illustrating waveforms of these signals. As shown in FIG. 22, the above-mentioned structure causes inverter control signals Sf1 and Sf2, which is used for general inverter control signals, to be generated. The inverter control signals Sf1 and Sf2 have, at the portions where their active states are switched, the dead time τd whose both ends are in inactive states. It is possible to use the inverter control signals Sf1 and Sf2 to control the general inverters Ui shown in FIGS. 18 and 19 and gates of switching elements of an inverters Ui' shown in FIG. 23, which will be described later.

In this embodiment, the inverter control signals Sf1 and Sf2 are respectively input to input terminals of logical product gates Ge3 and Ge4, and the current breaking signal SMs which is in an active state at a low level is input to the other input terminals of the logical product gates Ge3 and Ge4. The inverter control circuit Ue generates inverter control signals Se1 and Se2 each having inactive states at both ends thereof in periods ps1 and ps2 where the current breaking signal Sms is in an active state, in addition to the period of the dead time τd at the portions where the active states are switched.

When the inverter control signals Se1 and Se2 are used to control the gates of the switching elements of the inverter Ui shown in FIG. 20, controlling the active or inactive state of the output current modulation instruction signal Sq makes it possible to turn on or off the switching elements Q1, Q2, Q3, and Q4 of the inverter Ui directly connected to the discharge lamp Ld. Therefore, it is possible to rapidly break the lamp current and to rapidly release the breaking of the lamp current.

The discharge lamp lighting device shown in FIG. 19 is formed by adding the inverter Ui to the discharge lamp lighting device shown in FIG. 2. In the discharge lamp lighting device, switching elements constituting the inverter Ui are also used as the current control elements Qb of the variable current control circuit SWb for bypassing some of current components flowing through the discharge lamp Ld, which makes it possible to reduce the manufacturing costs of a discharge lamp lighting device.

In order for the above-mentioned operation, preferably, the discharge lamp lighting device includes a power supply circuit Ux for supplying power to the discharge lamp Ld; an inverter circuit Ui which is provided in the next stage of the power supply circuit Ux and includes, in order to repeatedly invert one polarity and the other polarity of a voltage applied to the discharge lamp Ld, one or more switching elements which are in a saturated connection state in the period where the one polarity of the voltage is maintained and one or more switching elements which are in a saturated connection state in the period where the other polarity of the voltage is maintained; and a current bypass control circuit Un having an output current modulation instruction signal Sq applied thereto. The power supply circuit Ux includes an output current detecting unit Ix for detecting an output current IO of the power supply circuit Ux to generate an output current detecting signal Si. When the output current modulation instruction signal Sq is in an active state, the current bypass control circuit Un controls the switching elements having the saturated connection states in the period where the other polarity of the voltage is maintained to have unsaturated connection states in the period where the one polarity of the voltage is maintained, thereby making a bypass current IB1 flow, and controls the switching elements having the saturated connection states in the period where the one polarity of the voltage is maintained to have unsaturated connection states in the period where the other polarity of the voltage is maintained, thereby making a bypass current IB2 flow. In this way, the current bypass control circuit Un performs control such that the bypass currents IB1 and IB2 are substantially equal to a value obtained by multiplying the output current IO by a proportional constant K. Therefore, the inverter Ui further includes bypass current detecting units Ib1 and Ib2 for detecting the bypass currents IB1 and IB2 to generate bypass current detecting signals Sb1 and Sb2.

Figure 23:
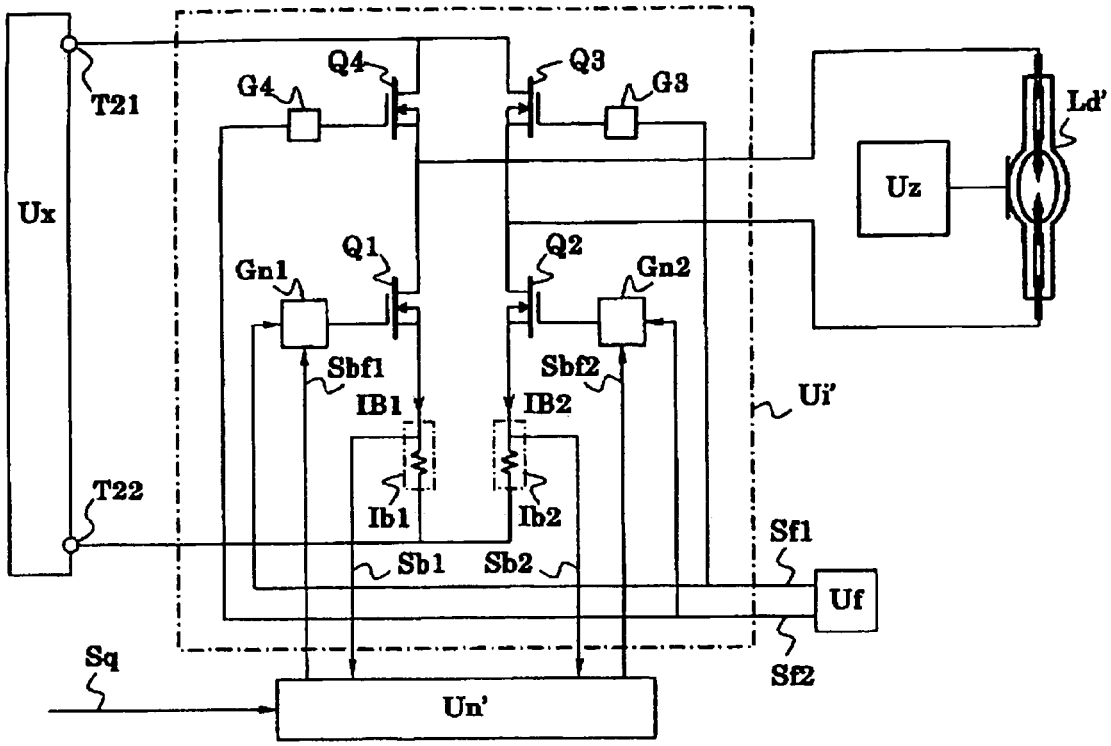
FIG. 23 is a diagram schematically illustrating a discharge lamp lighting device according to an embodiment of the invention.

FIG. 23 shows an example of the schematic structure of a discharge lamp lighting device using the AC driving method according to the invention. The discharge lamp lighting device includes an inverter Ui' of a full-bridge manner which is provided in the next stage of the power supply circuit Ux. In the discharge lamp lighting device, switching elements Q1 and Q2 of the inverter Ui' are also used as current control elements of a variable current control circuit SWb for bypassing some of current components flowing through the discharge lamp Ld.

Bypass current detecting units Ib1 and Ib2 is connected in series to the switching elements Q1 and Q2 in order to detect bypass currents IB1 and IB2 respectively flowing through the switching elements Q1 and Q2 to generate bypass current detecting signals Sb1 and Sb2. The bypass current detecting signals Sb1 and Sb2 are input to a current bypass control circuit Un'.

Similar to the inverters shown in FIGS. 18 and 19, gate driving circuits G3 and G4 are provided in the switching elements Q3 and Q4 of the inverter Ui', respectively, to control (saturated) connection or disconnection of the switching elements Q3 and Q4, on the basis of inverter control signals Sf1 and Sf2 output from an inverter control circuit Uf. Further, current control gate driving circuits Gn1 and Gn2 are respectively provided in the switching elements Q1 and Q2 to control (saturated) connection or disconnection of the switching elements Q1 and Q2, on the basis of the inverter control signals Sf1 and Sf2 and to control current limits such that the switching elements Q1 and Q2 are in unsaturated connection states, on the basis of current control intensity signals Sbf1 and Sbf2 output from the current bypass control circuit Un'.

Figure 24:
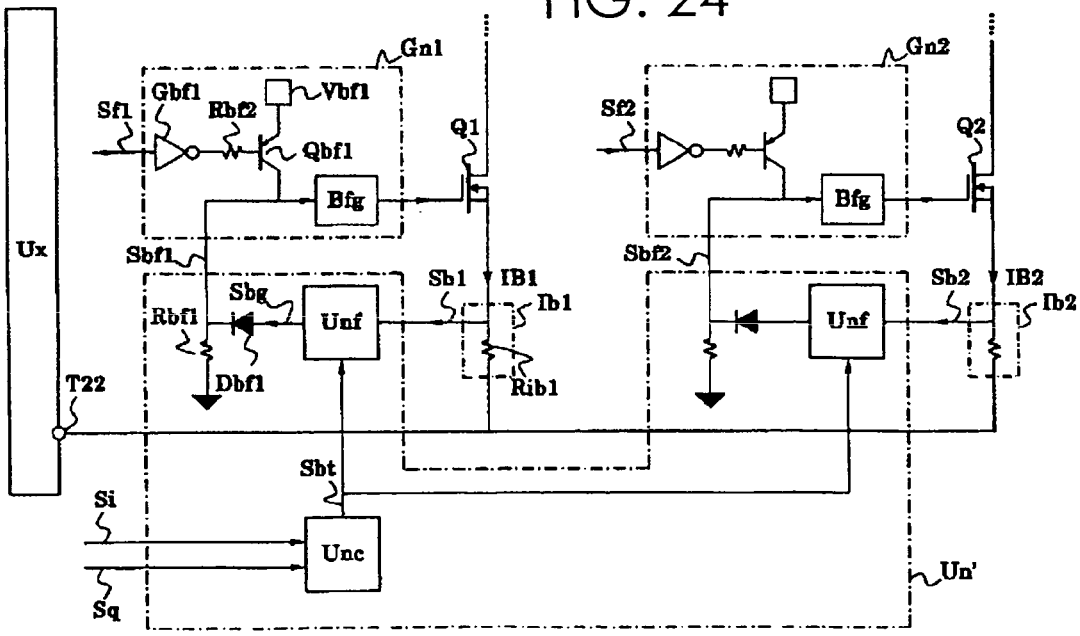
FIG. 24 is a diagram schematically illustrating a portion of the discharge lamp lighting device according to the embodiment of the invention.

FIG. 24 shows an example of the schematic structure of a portion of a discharge lamp lighting device including the current bypass control circuit Un' and the current control gate driving circuits Gn1 and Gn2. The bypass current detecting signal Sb1 output from the bypass current detecting unit Ib1 composed of a resistor Rib1 is input to the same functional block as shown in FIG. 15, and then an original current control intensity signal Sbg for realizing a bypass current target signal Sbt is generated, similar to the above-mentioned structure. The bypass current target signal Sbt is generated in the same functional block Unc as shown in FIG. 15 by the same method as described above, on the basis of an output current detecting signal Si and an output current modulation instruction signal Sq.

The inverter control signal Sf1 for a general inverter operation is input to the current control gate driving circuit Gn1. In this structure, for the polarity of the inverter control signal Sf1, it is assumed that, when the inverter control signal Sf1 is at a high level, the switching element Q1 is turned on for a general inverter operation; and when the inverter control signal Sf1 is at a low level, the switching element Q1 is turned off for the general inverter operation. In this case, preferably, when the inverter control signal Sf1 is at a low level, the switching element Q1 is controlled depending on the original current control intensity signal Sbg. On the other hand, preferably, when the inverter control signal Sf1 is at a high level, the switching element Q1 is turned on, regardless of the original current control intensity signal Sbg.

Therefore, a logic inverting gate Gbf1 is provided for matching the polarity of the inverter control signal Sf1, as described above. When the inverter control signal Sf1 is at a high level, it flows to a transistor Qbf1 through a resistor Rbf2, so that the transistor Qbf1 is turned on. Then, a current flows to a resistor Rbf1 from a voltage source Vbf1 having a voltage capable of saturating the switching element Q1 into an on state, which causes the voltage of the current control intensity signal Sbf1 to forcibly rise up to the voltage of the voltage source Vbf1. On the other hand, when the inverter control signal Sf1 is at a low level, the transistor Qbf1 is turned off. Then, the voltage of the current control intensity signal Sbf1 is changed to a voltage corresponding to the original current control intensity signal Sbg by a current flowing to the resistor Rbf1 through a diode Dbf1.

As such, the current control intensity signal Sbf1 has a voltage for causing the switching element Q1 to be turned on or a voltage corresponding to the original current control intensity signal Sbg, according to the inverter control signal Sf1. The current control intensity signal Sbf1 is input to a gate driving buffer Bfg in the same functional block shown in FIG. 15 to drive the gate of the switching element Q1.

A circuit for the switching element Q2 may be formed completely similar to the circuit for the switching element Q1 shown in FIG. 24 .urther, since the bypass current target signal Sbt input to a functional block Unf including the switching element Q2 is the same as that input to the functional block Unf including the switching element Q1, only one functional block Unc is provided.

In the discharge lamp lighting device having the above-mentioned structure, when the output current modulation instruction signal Sq is in an inactive state, the inverter Ui' shown in FIG. 23, serving as a general full-bridge inverter, applies an alternating discharge voltage to the discharge lamp Ld', on the basis of the inverter control signals Sf1 and Sf2 output from the inverter control circuit Uf, to turn it on. On the other hand, when the output current modulation instruction signal Sq is in an active state, the current bypass control circuit Un' rapidly performs feedback control such that a desired bypass current flows to one of the switching elements Q1 and Q2 which is in an off state at that time, so that a current flowing through the discharge lamp Ld' is rapidly reduced by an amount of the bypass current.

The above-mentioned circuit structures are just illustrative examples for describing the operation, function, and effect of the discharge lamp lighting device of the invention, but the invention is not limited thereto. Therefore, the invention premises that a detained circuit structure or operation, for example, the polarities of signals, can be changed at the time when the device is actually designed, on the basis of the selection, addition, or omission of circuit elements, the convenience of acquisition of elements, and economic reasons.

In particular, the invention premises that a structure for protecting switching elements composed of, for example FETs from, for example, an overvoltage, an overcurrent, and overheating, or a structure for reducing radiation noise or conduction noise generated by the operation of circuit elements of a power supply circuit or preventing the generated noise from being transmitted to the outside, for example, a snubber circuit, a varistor, a clamping diode, a current control circuit (which includes a pulse-by-pulse method), a common-mode or normal-mode noise filter choke coil, or a noise filter capacitor, can be additionally provided to each unit of the circuit structures described in the embodiments, if necessary. The structure of the discharge lamp lighting device according to the invention is not limited to the above-mentioned circuit methods, and is also limited to the above-mentioned waveforms or timing charts.

Further, for example, in the above-described embodiments, the lamp voltage detecting signal corresponding to the lamp voltage is converted into a digital signal, and the output current target signal is set on the basis of the converted signal. However, a lamp current detecting signal corresponding to a lamp current may be converted into a digital signal, and an output current target signal may be corrected and set such that the obtained current value is equal to a target current value, which makes it possible to correct a variation in the parameters of each circuit elements, resulting in a high-precision and high-performance device. In addition, for example, the microprocessor unit may be removed to simplify a control circuit. A light source device with these variable structures can also exhibit the effects of the invention.

What is claimed is:

1. A discharge lamp lighting device for lighting a discharge lamp having a pair of main discharge electrodes facing each other, comprising:

a power supply circuit which supplies power to the discharge lamp;

a current breaking switch circuit which breaks a current flowing through the discharge lamp; and a modulation control signal generating circuit to which an output current modulation instruction signal is input, wherein the power supply circuit includes a capacitor which stabilizes an output voltage of the power supply circuit, an output current detecting unit which detects an output current of the power supply circuit to generate an output current detecting signal, an output current error calculating circuit which calculates an error between the output current detecting signal and an output current target signal indicating a control target value with respect to the output current detecting signal, and a power supply driving circuit which defines the capability of the power supply circuit on the basis of the output of the output current error calculating circuit, and when the output current modulation instruction signal is activated, the modulation control signal generating circuit holds at least one of an output signal of the output current error calculating circuit and the output current detecting signal to stop the capacitor from being charged and to turn off the current breaking switch circuit.

2. The discharge lamp lighting device according to claim 1, further comprising a temporary booster unit which temporarily raises a voltage to be applied to the discharge lamp Ld, wherein, when the output current modulation instruction signal returns to an inactive state, the modulation control signal generating circuit operates the temporary booster unit.

3. The discharge lamp lighting device according to claim 1 or 2, further comprising an inverter which is provided in a subsequent stage of the power supply circuit and includes switching elements for repeatedly inverting the polarity of the voltage to be applied to the discharge lamp, wherein at least one of the switching elements of the inverter is used as a part of the current breaking switch circuit.

* * * * *